US011092913B2

(12) United States Patent
Shiokawa et al.

(10) Patent No.: US 11,092,913 B2
(45) Date of Patent: Aug. 17, 2021

(54) IMAGE FORMING APPARATUS

(71) Applicant: Konica Minolta, Inc., Tokyo (JP)

(72) Inventors: Yasuo Shiokawa, Hino (JP); Yoshiteru Kawakami, Kokubunji (JP); Takahiro Okubo, Yokohama (JP)

(73) Assignee: Konica Minolta, Inc., Tokyo (JP)

( * ) Notice: Subject to any disclaimer, the term of this patent is extended or adjusted under 35 U.S.C. 154(b) by 301 days.

(21) Appl. No.: 15/997,885

(22) Filed: Jun. 5, 2018

(65) Prior Publication Data

US 2019/0072883 A1 Mar. 7, 2019

(30) Foreign Application Priority Data

Jun. 16, 2017 (JP) ..... JP2017-118216
Jun. 28, 2017 (JP) ..... JP2017-125735
Jul. 3, 2017 (JP) ..... JP2017-130395

(51) Int. Cl.
*G03G 15/20* (2006.01)
*G03G 15/00* (2006.01)
*G03G 15/16* (2006.01)

(52) U.S. Cl.
CPC ..... *G03G 15/20* (2013.01); *G03G 15/16* (2013.01); *G03G 15/607* (2013.01);
(Continued)

(58) Field of Classification Search
CPC ..... G03G 15/20; G03G 15/16; G03G 15/607; G03G 15/6511; G03G 15/657; G03G 15/6561; G03G 15/6567
See application file for complete search history.

(56) References Cited

U.S. PATENT DOCUMENTS 8,210,632 B2 * 7/2012 Naoi ..... B41J 29/393 347/14
10,358,311 B2 * 7/2019 Yamane ..... G03G 15/6561
(Continued)

FOREIGN PATENT DOCUMENTS

JP H05-006114 A 1/1993
JP 2013-033151 A 2/2013
(Continued)

OTHER PUBLICATIONS

Japan Patent Application No. 2017-125735; Notice of Reasons for Refusal; dated Apr. 13, 2021; 5 pages.
(Continued)

*Primary Examiner* — David H Banh
(74) *Attorney, Agent, or Firm* — Baker Hostetler

(57) ABSTRACT

An image forming apparatus includes: a transfer unit, a fixing unit, a sway roller pair constituted of a pair of rollers, a first detector and a hardware processor. The transfer unit transfers an image onto paper. The fixing unit fixes, to the paper, the image transferred onto the paper by the transfer unit. The sway roller pair conveys the paper to the transfer unit, the paper being conveyed to the sway roller pair. The first detector is provided on a downstream side of the transfer unit but on an upstream side of the fixing unit and detects a position of a side edge of the paper. The hardware processor performs sway control of the sway roller pair based on a detection result of the detection by the first detector.

18 Claims, 13 Drawing Sheets

(52) U.S. Cl.
CPC ..... *G03G 15/657* (2013.01); *G03G 15/6511* (2013.01); *G03G 15/6561* (2013.01); *G03G 15/6567* (2013.01)

(56) References Cited

U.S. PATENT DOCUMENTS

2003/0227534 A1* 12/2003 Enomoto ..... B41J 2/325 347/177
2003/0227535 A1* 12/2003 Enomoto ..... B41J 2/36 347/188
2011/0076035 A1* 3/2011 Iwakawa ..... G03G 15/6558 399/16
2011/0148033 A1* 6/2011 Williams ..... B65H 9/002 271/228
2015/0098715 A1* 4/2015 Sakurai ..... G03G 15/70 399/18
2016/0159598 A1* 6/2016 Yamane ..... B65H 9/002 271/227
2016/0161894 A1* 6/2016 Shinkawa ..... G03G 15/6564 399/395
2016/0200535 A1* 7/2016 Shiina ..... B65H 7/20 271/265.01
2016/0349685 A1* 12/2016 Kato ..... G03G 15/50
2016/0357138 A1* 12/2016 Nakamura ..... B65H 3/128

FOREIGN PATENT DOCUMENTS

JP 2013-91563 5/2013
JP 2014-133634 7/2014
JP 2015-020830 A 2/2015
JP 2015-094876 A 5/2015
JP 2016-108152 A 6/2016
JP 2016-164690 A 9/2016

OTHER PUBLICATIONS

Japan Patent Application No. 2017-118216; Notice of Reasons for Refusal; dated Apr. 6, 2021; 8 pages.
Japan Patent Application No. 2017-130395; Notice of Reasons for Refusal; dated Apr. 17, 2021; 7 pages.

* cited by examiner

121

| TIMING / PAPER TYPE | 1 | | | 2 | | | … | n | | |
|---|---|---|---|---|---|---|---|---|---|---|
| | SWAY AMOUNT | DIRECTION | SPEED | SWAY AMOUNT | DIRECTION | SPEED | … | SWAY AMOUNT | DIRECTION | SPEED |
| PAPER TYPE A | 0.3 | + | $V_1$ | 0.4 | + | $V_1$ | … | – | – | – |
| PAPER TYPE B | 0.4 | + | $V_2$ | 0.5 | + | $V_2$ | … | 0.6 | + | $V_3$ |
| PAPER TYPE C | 0.5 | + | $V_1$ | 0.6 | + | $V_1$ | … | 0.7 | + | $V_2$ |
| ⋮ | ⋮ | ⋮ | ⋮ | ⋮ | ⋮ | ⋮ | … | ⋮ | ⋮ | ⋮ |

IMAGE FORMING APPARATUS

BACKGROUND

1. Technological Field

The present invention relates to an image forming apparatus.

2. Description of the Related Art

In recent years, multifunctional image forming apparatuses having functions of a printer, a scanner, a copier, a facsimile and so forth have been widely used. In this type of image forming apparatus, at the time of image forming, paper is conveyed from a paper feeder or a reverse path to a transfer unit. At the time, due to a mechanical factor of the apparatus or the like, the paper may head toward one side in a direction (hereinafter "paper width direction") orthogonal to a paper conveying direction in which the paper is conveyed. If printing is performed in this state, in which the paper heads toward one side in the paper width direction (hereinafter "paper one-side heading"), the position of an image to be formed on the paper deviates from its original proper position, which is a problem.

In order to perform accurate positioning of an image on paper taking the paper one-side heading into account, rollers for registration (hereinafter "registration roller pair") hold and sandwich paper and sway the paper in the paper width direction, thereby correcting the paper one-side heading.

For example, there is disclosed in Japanese Patent Application Publication No. 2013-91563 an image forming apparatus having: a registration roller pair on the upstream side of a pair of rollers for secondary transfer (hereinafter "secondary transfer roller pair); and a line sensor on the downstream side of the registration roller pair but on the upstream side of the secondary transfer roller pair, wherein the registration roller pair sways paper in the paper width direction on the basis of the position of a side edge of the paper detected by the line sensor, thereby correcting the paper one-side heading.

Further, there is disclosed in Japanese Patent Application Publication No. 2014-133634 arranging a plurality of CISs on the downstream side of a registration roller pair but on the upstream side of a secondary transfer roller pair, before a sheet of paper enters the secondary transfer roller pair, detecting the position of a side edge of the sheet with a CIS arranged near the registration roller pair and moving the registration roller pair in the paper width direction on the basis of the detection result, and during image transfer, moving the registration roller pair in the paper width direction on the basis of the detection result with a CIS arranged near the secondary transfer roller pair, thereby adjusting the position of the sheet.

However, the technology of detecting the position of a side edge of paper before the paper passes through a secondary transfer roller pair and swaying a registration roller pair on the basis of the detection result, thereby adjusting the position of the side edge of the paper, which is disclosed in Japanese Patent Application Publications No. 2013-91563 and No. 2014-133634, cannot suppress deviation of the paper, which occurs after detection of the side edge of the paper or sway of the registration roller pair. As a result of that, the position of an image (hereinafter "image position" or "toner image position") on the paper may deviate.

SUMMARY

The present invention has been conceived in view of the above circumstances, and objects of the present invention include suppressing deviation of the position of an image (image position) on paper with high accuracy.

In order to achieve at least one of the abovementioned objects, according to an aspect of the present invention, there is provided an image forming apparatus including: a transfer unit that transfers an image onto paper; a fixing unit that fixes, to the paper, the image transferred onto the paper by the transfer unit; a sway roller pair constituted of a pair of rollers that conveys the paper to the transfer unit, the paper being conveyed to the sway roller pair; a first detector that is provided on a downstream side of the transfer unit but on an upstream side of the fixing unit and detects a position of a side edge of the paper; and a hardware processor that performs sway control of the sway roller pair based on a detection result of the detection by the first detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION OF EMBODIMENTS

Hereinafter, one or more embodiments of the present invention will be described in detail with reference to the drawings. However, the scope of the invention is not limited to the disclosed embodiments or illustrated examples.

First Embodiment

[Configuration of Image Forming Apparatus 100]

First, configuration of an image forming apparatus 100 according to a first embodiment is described.

Figure 1:
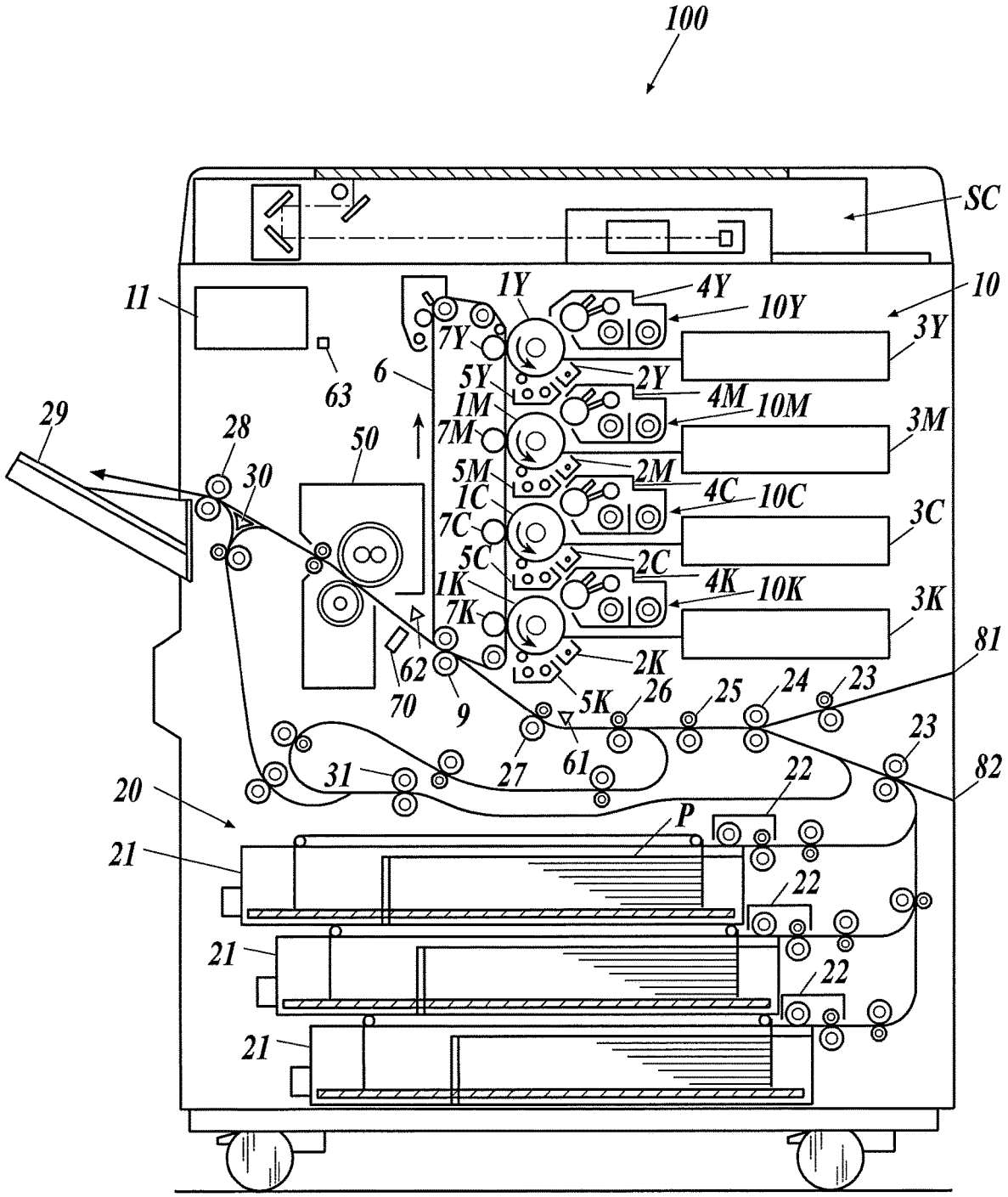
FIG. 1 schematically shows configuration of an image forming apparatus according to a first embodiment of the present invention.

FIG. 1 schematically shows the image forming apparatus 100 according to this embodiment. This image forming apparatus 100 is an electrophotographic image forming apparatus 100, such as a copier, and, what is called, a tandem color image forming apparatus having photoreceptors arranged in a vertical direction in such a way as to face one intermediate transfer belt, thereby forming full-color images.

The image forming apparatus 100 includes a document scanner SC, an image former 10, a fixing device 50 and a controller 11 as main components, and these components are housed in one casing.

The document scanner SC scans and thereby exposes images of documents with an optical system of a scanning exposure device, and reads the reflected light with a line image sensor, thereby obtaining image signals. The image signals are input to the controller 11 as image data after being subjected to image processing, such as A/D conversion, shading correction and compression. The image data input to the controller 11 are not limited to those read by the document scanner SC and may be image data received by a communication unit 13 from a personal computer or another image forming apparatus connected to the image forming apparatus 100.

The image former 10 includes four image forming units 10Y, 10M, 10C, 10K, an intermediate transfer belt 6, and a secondary transfer roller pair 9. The image forming units 10Y, 10M, 10C, 10K form yellow (Y) images, magenta (M) images, cyan (C) images and black (K) images, respectively.

The image forming unit 10Y includes: a photoconductive drum 1Y; and a charger 2Y, an optical writer 3Y, a developing device 4Y and a drum cleaner 5Y arranged around the photoconductive drum 1Y. Similarly, the image forming units 10M, 10C, 10K include: photoconductive drums 1M, 1C, 1K; and chargers 2M, 2C, 2K, optical writers 3M, 3C, 3K, developing devices 4M, 4C, 4K and drum cleaners 5M, 5C, 5K arranged around their respective photoconductive drums 1M, 1C, 1K.

The chargers 2Y, 2M, 2C, 2K charge surfaces of the photoconductive drums 1Y, 1M, 1C, 1K uniformly, and the optical writers 3Y, 3M, 3C, 3K form latent images on the photoconductive drums 1Y, 1M, 1C, 1K by scanning exposure. The developing devices 4Y, 4M, 4C, 4K visualize the latent images on the photoconductive drums 1Y, 1M, 1C, 1K by developing the latent images with toners, thereby forming toner images of predetermined colors corresponding to yellow, magenta, cyan and black on the photoconductive drums 1Y, 1M, 1C, 1K. The toner images formed on the photoconductive drums 1Y, 1M, 1C, 1K are successively transferred by primary transfer rollers 7Y, 7M, 7C, 7K onto a predetermined point on the rotating intermediate transfer belt 6.

The toner image of the colors transferred onto the intermediate transfer belt 6 is transferred by the secondary transfer roller pair 9 onto paper P conveyed thereto by the below-described paper conveyor 20 at a predetermined timing. The secondary transfer roller pair 9 is a pressure contact member that forms a nip part (hereinafter "transfer nip part") by being arranged to press and contact the intermediate transfer belt 6.

The paper conveyor 20 conveys the paper P along a paper conveyance path. The paper P is housed in a paper feeding tray(s) 21. The paper P housed in the paper feeding tray 21 is taken by a paper feeder 22 to be sent out to the conveyance path. Alternatively, the paper P is housed in a paper feeding tray(s) of an external paper feeding apparatus (not shown) connected to the image forming apparatus 100 via an external paper feeding port 81, 82 or the like. The paper P which the paper feeding apparatus has is supplied from this paper feeding apparatus to the image forming apparatus 100 via the external paper feeding port 81 or 82 and sent out to the conveyance path. For example, long paper is supplied from the external paper feeding apparatus to the image forming apparatus 100 via the external paper feeding port 81 or 82.

On this conveyance path, on the upstream side of the transfer nip part, conveying units that convey the paper P are arranged. Each conveying unit is constituted of a pair of rollers that press against and contact with each other, and at least one of the rollers is rotationally driven through a drive mechanism that includes an electric motor as a main component, thereby conveying the paper P. Each pair of rollers constituting each conveying unit is configured to switch its inter-roller state between a press-and-contact state and a separate state.

In this embodiment, from the upstream side to the downstream side of the conveyance path, intermediate conveying roller pairs 23 to 25, a loop roller pair 26 and a registration roller pair 27 are arranged as the conveying units. Each conveying unit is not limited to a pair of rollers as described above, and can be any pair of rotational members of a wide range. For example, a conveying unit may be a combination of belts or a combination of a belt and a roller.

On this conveyance path, sheets of the paper P fed from the paper feeding tray 21 or the paper feeding tray of the paper feeding apparatus are successively conveyed by the intermediate conveying roller pairs 23 to 25 and the loop roller pair 26 arranged from the upstream side to the downstream side and thereby travel on the conveyance path. When the top of (a sheet of) the paper P conveyed by the loop roller pair 26 and so forth approaches the registration roller pair 27, the paper P abuts the registration roller pair 27 that is in a rotation-suspended state, and a loop (warp) is formed on the paper P by the loop roller pair 26 still rotating for a predetermined time. By action of this loop forming, a skew of the top of the paper P is corrected (skew correction).

When the registration roller pair 27 restarts rotating at a predetermined timing such that the position of the paper P can be proper for the toner image held by the intermediate transfer belt 6, the intermediate conveying roller pairs 23 to 25 and the loop roller pair 26 switch from the press-and-contact state to the separate state. That is, when the loop roller pair 26 switches to the separate state, the paper P is conveyed by the registration roller pair 27 only. The registration roller pair 27 performs the below-described sway process as a sway roller pair constituted of a pair of rollers while conveying the paper P, and conveys the paper P to the transfer nip part constituted of the intermediate transfer belt 6 as an image holder and the secondary transfer roller pair 9 as a transfer unit.

Figure 2:
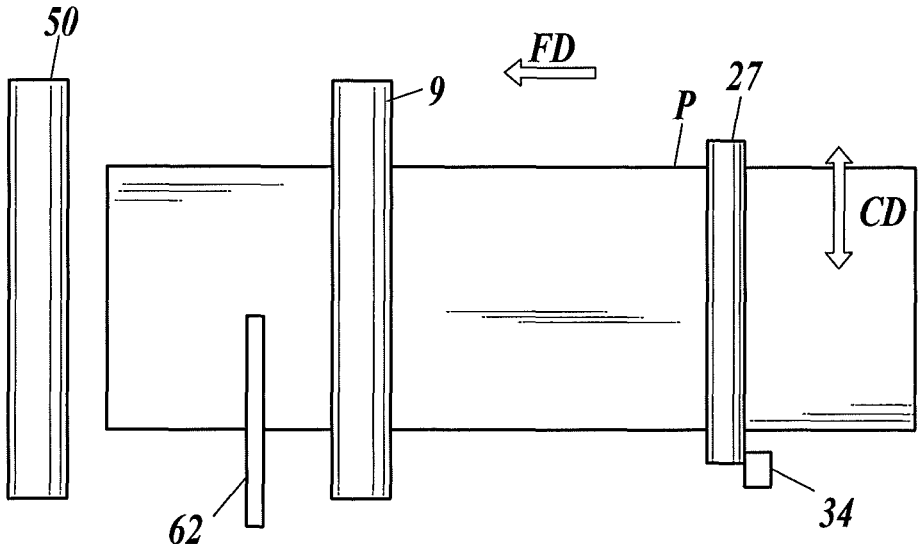
FIG. 2 shows arrangement of a position detection sensor and a sway process of paper by a registration roller pair from the above.

As shown in FIG. 2, the registration roller pair 27 is configured to sway in a paper width direction CD (direction orthogonal to a paper conveying direction (sub-scanning direction) FD). The registration roller pair 27 is connected to a drive mechanism 34 having an electric motor (e.g. a stepping motor) as a main component, and can move in the paper width direction CD by being driven by the drive mechanism 34, taking a predetermined home position as a start position.

The registration roller pair 27 moves along the paper width direction CD during a passing period during which the paper P passes through the registration roller pair 27, thereby moving the paper P, which is being conveyed, along the paper width direction CD (sway process). Thus, the registration roller pair 27 adjusts the position of the paper P in the paper width direction CD such that the position of the paper P agrees with the position of the toner image to be transferred onto the paper P.

A registration sensor 61 is arranged between the registration roller pair 27 and the loop roller pair 26 over the conveyance path. The registration sensor 61 detects arrival of the top of the paper P at a detection position of the registration sensor 61 (a position a predetermined distance before the registration roller pair 27). This detection result by the registration sensor 61 is used for detection of a rotation start timing of the registration roller pair 27 and so forth.

Figure 3:
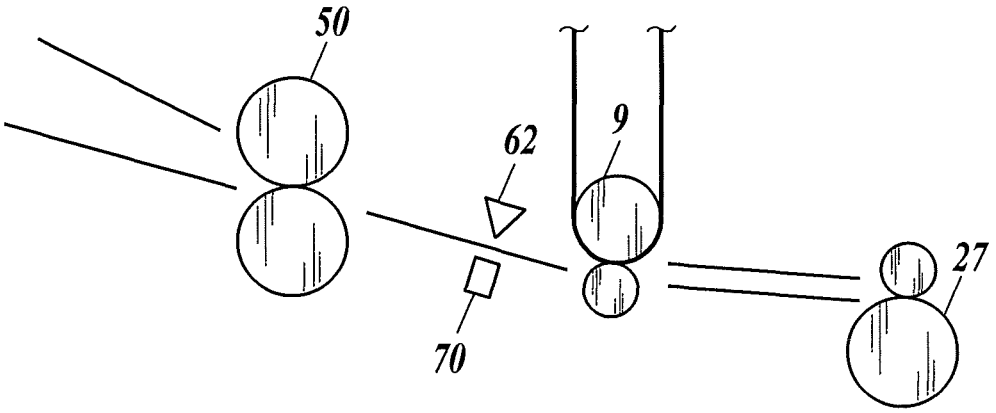
FIG. 3 shows arrangement of the position detection sensor and a suction fan.

As shown in FIG. 2 and FIG. 3, a position detection sensor 62 is provided on the downstream side of the secondary transfer roller pair 9 but on the upstream side of the fixing device 50 over an imaging side (a side where toner images are formed/transferred on/onto the paper P) of the conveyance path. The position detection sensor 62 includes a linear image sensor (e.g. a CCD line sensor) in which light receiving elements are arranged linearly along the paper width direction CD, an optical system and a light source. The position detection sensor 62 is a detector that detects the position of a side edge of the paper P in the paper width direction CD after the toner image is transferred onto the paper P by the secondary transfer roller pair 9. In this embodiment, the position detection sensor 62 reads the paper P from above the imaging side, and accordingly can detect the position of the toner image transferred onto the paper P. The detection result by the position detection sensor 62 is output to the controller 11, and used for determination of sway control information on the registration roller pair 27 used for the sway process, and so forth.

As shown in FIG. 3, a suction fan 70 is provided under the conveyance path in such a way as to face the position detection sensor 62. For example, vent hole(s) are made in a lower guide (conveyor belt) of the conveyance path, and suction is performed by the suction fan 70, so that the paper P can be conveyed along and on the lower guide. This can prevent the toners on the paper P from adhering to the position detection sensor 62. Further, the above makes it possible to arrange the position detection sensor 62 near the imaging side and accordingly increase the detection accuracy.

The fixing device 50 is a device that performs a fixing process on the paper P onto which the toner image has been transferred, namely, the paper P sent out from the transfer nip part, and includes, for example, a pair of fixing members (e.g. a pair of rollers) and a heater that heats one or both of the fixing members. In the process of conveyance of the paper P, the fixing device 50 fixes the toner image to the paper P by pressure of the fixing members and action of heat which the fixing members has.

The paper P subjected to the fixing process by the fixing device 50 is ejected by a pair of rollers for paper ejection (hereinafter "paper ejection roller pair") 28 onto a paper receiving tray 29 attached to an outer lateral surface of the casing. If an image(s) is also formed on the back side of the paper P, the paper P with the image(s) formed on the front side is conveyed by a switching gate 30 to a pair of rollers for reverse (hereinafter "reverse roller pair) 31 provided on the lower side in the image forming apparatus 100. The rollers of the reverse roller pair 31 sandwich and hold the bottom of the paper P conveyed thereto, and then reverse the paper P by sending the paper P backward, thereby sending out the reversed paper P to a paper re-feeding conveyance path. The paper P sent out to this paper re-feeding conveyance path is conveyed by a plurality of conveying units for paper re-feeding, thereby being returned to the transfer nip part via the registration roller pair 27. The paper ejection roller pair 28, the switching gate 30, the reverse roller pair 31 and the conveying units for paper re-feeding are also included in the above-described paper conveyor 20.

Figure 4:
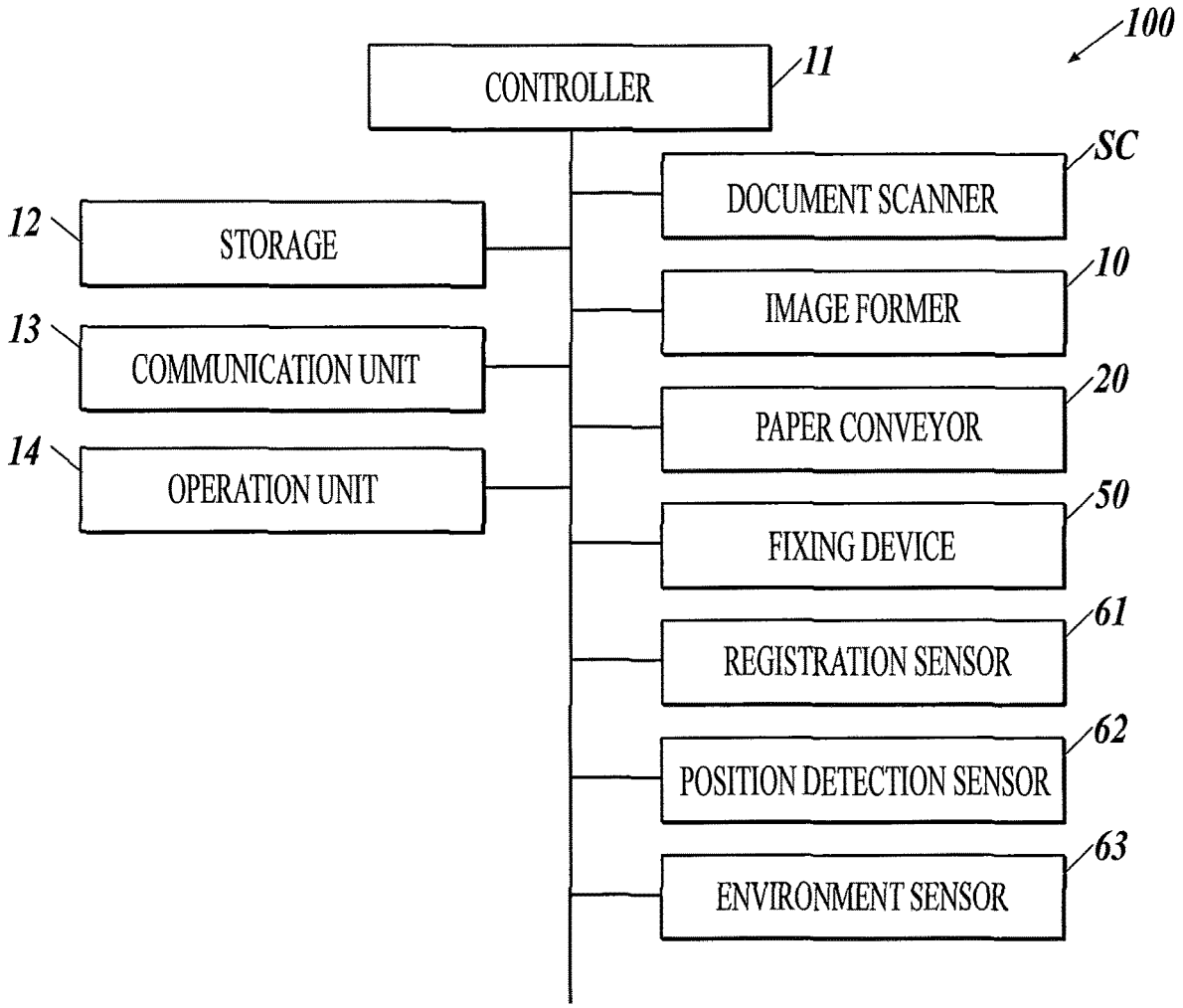
FIG. 4 is a block diagram schematically showing configuration of a control system of the image forming apparatus shown in FIG. 1.

As shown in FIG. 4, the controller 11 is connected to a storage 12, the communication unit 13, an operation unit 14, the document scanner SC, the image former 10, the paper conveyor 20, the fixing device 50, the registration sensor 61, the position detection sensor 62 and an environment sensor 63. The controller 11 includes a CPU (Central Processing Unit, hardware processor) and a RAM (Random Access Memory). The CPU of the controller 11 reads system programs and various process programs including a program to perform a sway control process A stored in the storage 12, opens the read programs on the RAM, and performs centralized control of operations of the components of the image forming apparatus 100 in accordance with the opened programs. For example, when a job execution instruction is input through the operation unit 14, the controller 11 executes a job and performs control to form a toner image(s) on the paper P on the basis of image data input through the document scanner SC or the communication unit 13. When the job execution instruction is input through the operation unit 14, the controller 11 also performs the sway control process A described below so as to perform sway control of the registration roller pair 27 that is in execution of the job.

The storage 12 is constituted of a nonvolatile semiconductor memory, an HDD (Hard Disk Drive) and/or the like, and stores the various programs that are executed by the controller 11, and parameters, data and so forth needed by the components of the image forming apparatus 100.

The communication unit 13 includes various interfaces, such as an NIC (Network Interface Card), a MODEM (Modulator-DEModulator) and a USB (Universal Serial Bus), and connects the image forming apparatus 100 to external apparatuses.

The operation unit 14 outputs various types of information set by a user to the controller 11. As the operation unit 14, for example, a touchscreen through which input operations can be made in accordance with information displayed on its display can be used. Through this operation unit 14, a user can set a printing condition(s), such as a paper type, a basis weight and/or a size of the paper P, a paper feeding tray to be used, an image density, a magnification ratio, and double-sided printing or not (i.e. single-sided printing). Further, through the operation unit 14, a user can input a job execution instruction(s) and an instruction(s) for operation in an adjustment mode. The controller 11 controls the operation unit 14, so that various massages can be displayed for a user through the operation unit 14.

The environment sensor 63 includes, for example, a temperature sensor and a humidity sensor, and detects temperature and humidity in the casing of the image forming apparatus 100 and outputs the detection result to the controller 11.

[Operation of Image Forming Apparatus 100]

Next, operation of the image forming apparatus 100 according to the first embodiment is described.

Figure 5:
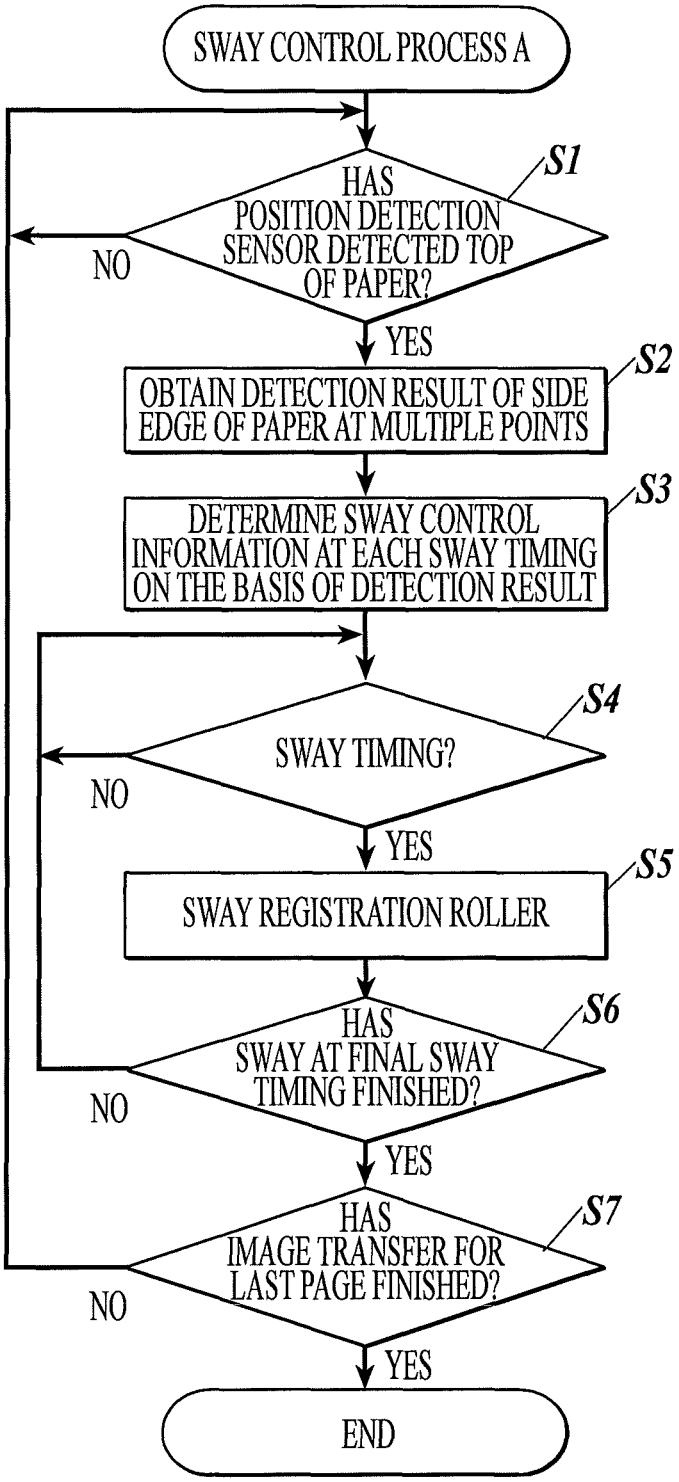
FIG. 5 is a flowchart showing a sway control process A that is performed in the first embodiment by a controller shown in FIG. 4.

FIG. 5 is a flowchart showing the sway control process A to control sway of the registration roller pair 27. The process shown in this flowchart is performed by the controller 11 in cooperation with the program stored in the storage 12 in response to a job execution instruction from a user.

When a job is started, the controller 11 waits until the position detection sensor 62 detects the top of the paper P (Step S1).

When the position detection sensor 62 detects the top of the paper P (Step S1; YES), the controller 11 obtains a detection result of the position of a side edge of the paper P at multiple points (e.g. two points) detected by the position detection sensor 62 (Step S2).

Next, the controller 11 determines, on the basis of the detection result by the position detection sensor 62, the sway control information on the registration roller pair 27 at (or for) each of predetermined sway timings (Step S3). The sway timings are timings at which the registration roller pair 27 is swayed. In this embodiment, multiple sway timings are predetermined (at approximately regular intervals), for example, in t1 seconds, t2 seconds, . . . and so forth after detection of the top of the paper P by the position detection sensor 62, for example.

Figures 6, 7:
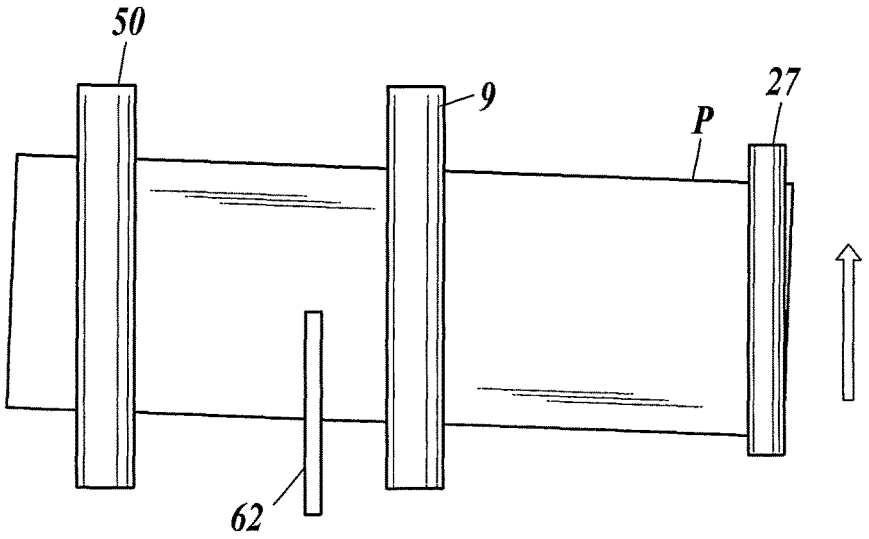
FIG. 6 shows an example of sub-scanning curving.
FIG. 7 shows an example of a sway control table.

As shown in FIG. 6, sub-scanning curving, which is a phenomenon of paper being curved in the paper conveying direction from somewhere on the paper, may occur after the paper P enters the registration roller pair 27, for example, by misalignment of the registration roller pair 27, the secondary transfer roller pair 9 and the fixing roller pair (i.e. the fixing members) of the fixing device 50 or by difference between roller diameters of the front/near side and the back/far side of each roller when the image forming apparatus 100 is viewed from the front. As a result of that, the position of the paper P with respect to a transfer position of the secondary transfer roller pair 9 deviates, and hence a toner image(s) cannot be transferred to the optimum position (hereinafter "image's optimum position", for example, the position where the center in the width direction of the paper P matches the center in the width direction of the toner image). In this embodiment, the position detection sensor 62 provided on the downstream side of the secondary transfer roller pair 9 detects the actual position of the side edge of the paper P after the image transfer, and the controller 11 determines, on the basis of the detection result, a sway amount of the registration roller pair 27 and so forth and makes the registration roller pair 27 sway, thereby adjusting the position of the side edge of the paper P, and accordingly can suppress deviation of the position of the paper P with respect to the transfer position. For example, in the case shown in FIG. 6, the registration roller pair 27 is swayed (moved) in a direction indicated by an arrow.

For example, the controller 11 obtains the detection result of the position (X1 and X2) of the side edge of the paper P at two points in the sub-scanning direction on the top side of the paper P detected by the position detection sensor 62 (Step S2). Then, the controller 11 calculates a slope of the paper P on the basis of the obtained detection result, calculates a deviation amount from a target position for the side edge of the paper P at each sway timing on the basis of the calculated slope, and determines the sway control information (the sway amount, a sway direction and a sway speed) at each sway timing on the basis of the calculated deviation amount (Step S3). The target position indicates the position that is expected to let a toner image(s) be transferred to the image's optimum position on the paper P if the side edge of the paper P moves thereon. Because the position of the registration roller pair 27 can be obtained thanks to the stepping motor of the drive mechanism 34, the controller 11 may determine the sway control information on the basis of the detection result by the position detection sensor 62 and the position information on the registration roller pair 27.

The slope of the paper P can be calculated, for example, by the following equation.

$$\text{Slope of Paper } P = (\text{Difference between } X1 \text{ and } X2 \text{ in Paper Width Direction})/(\text{Conveyance Distance between } X1 \text{ and } X2)$$

The sway amount can be calculated, for example, by the following equation.

$$\text{Sway Amount} = \text{Deviation Amount from Target Position for Side Edge of Paper } P \times \alpha$$

The "α" is a coefficient. The conveyance state of the paper P differs depending on a condition(s) relevant to paper conveyance (hereinafter "paper conveyance condition"), such as a paper type of the paper P, a basis weight of the paper P, an environment (temperature, humidity, etc.) and/or a paper size (paper width, paper length, etc.) of the paper P. Hence, it is preferable that the coefficient α differ according to the paper conveyance condition and the sway timing(s) (i.e. point(s) in the sub-scanning direction, the point(s) to be swayed). Further, it is preferable that the sway speed be faster as the sway amount is larger.

Because the position detection sensor 62 can obtain image information on a toner image(s), the controller 11 may determine the sway control information on the registration roller pair 27 on the basis of the detection result of the position of the side edge of the paper P and the position of the toner image on the paper P by the position detection sensor 62. For example, the controller 11 calculates, on the basis of the detection result of the position of the side edge of the paper P and the position of the toner image on the paper P at multiple points detected by the position detection sensor 62, distance and slope between the side edge of the paper P and the toner image on the paper P at each point, and calculates, on the basis of the calculated distance and slope, distance between the side edge of the paper P and the toner image on the paper P at each sway timing. Then, the controller 11 calculates a difference (deviation amount) between (i) each calculated distance and (ii) its ideal distance, namely, distance between the side edge of the paper P and the toner image on the paper P when the toner image is arranged at the image's optimum position, and determines the sway control information at each sway timing on the basis of the calculated deviation amount. This can place the toner image on the image's optimum position with high accuracy.

Next, the controller 11 waits for a sway timing of the registration roller pair 27 to come (Step S4). When determining that the sway timing has come (Step S4; YES), the controller 11 causes the drive mechanism 34 to sway the registration roller pair 27 on the basis of the sway control information determined in Step S3 for the sway timing (Step S5).

Next, the controller 11 determines whether or not the sway at the final sway timing has finished (Step S6). For example, the controller 11 determines whether or not the sway at the final sway timing has finished on the basis of the paper size of the paper P, the elapsed time since detection of the top of the paper P by the position detection sensor 62 and a conveyance speed of the paper P.

When determining that the sway at the final sway timing has not finished yet (Step S6; NO), the controller 11 returns to Step S4 and waits for the next sway timing, and when the next sway timing comes, causes the drive mechanism 34 to sway the registration roller pair 27, namely, repeats Steps S4 to S6.

On the other hand, when determining that the sway at the final sway timing has finished (Step S6; YES), the controller 11 determines whether or not the image transfer for the last page has finished (Step S7).

When determining that the image transfer for the last page has not finished yet (Step S7; NO), the controller 11 returns to Step S1.

On the other hand, when determining that the image transfer for the last page has finished (Step S7; YES), the controller 11 ends the sway control process A.

Thus, in the first embodiment, the position detection sensor 62 is provided on the downstream side of the secondary transfer roller pair 9, and on the basis of the detection result (the position of the side edge of the paper P and/or the position of the toner image on the paper P) on the top side of the paper P by the position detection sensor 62, the controller 11 controls the sway of the registration roller pair 27 on the bottom side of the paper P. That is, the controller 11 makes the registration roller pair 27 sway on the basis of deviation of the actual position of the side edge of the paper P from the target position after the image transfer, thereby adjusting the position of the side edge of the paper P. This can suppress, with high accuracy, deviation of the toner image position on the paper P caused by the sub-scanning curving. This effect is significant on paper that is long in the paper conveying direction, such as the long paper, in particular.

Second Embodiment

Next, a second embodiment of the present invention is described.

In the second embodiment, on the basis of the detection result by the position detection sensor 62 provided on the downstream side of the secondary transfer roller pair 9, the sway control information on the registration roller pair 27 for the subsequent sheet(s) of the paper P is determined.

In the second embodiment, the storage 12 stores, in addition to the various programs that are executed by the controller 11, and the parameters, data and so forth needed by the components of the image forming apparatus 100, a sway control table 121.

The sway control table 121 is a table where the sway control information to control the sway of the registration roller pair 27 is stored. In the sway control table 121, the sway control information (here, the sway amount, the sway direction and the sway speed) for each of the sway timings (timings 1 to n) at which the sway control of the registration roller pair 27 is performed is stored. In this embodiment, the sway timings are determined such that the paper P is swayed at approximately regular intervals from the top to the bottom of the paper P.

The state of the paper P during conveyance (i.e. the conveyance state of the paper P) differs depending on the paper conveyance condition, such as the paper type of the paper P, the basis weight of the paper P, the environment (temperature, humidity, etc.) and/or the paper size (paper width, paper length, etc.) of the paper P. Hence, in order to write a toner image(s) at the image's optimum position on the paper P with high accuracy, it is preferable to store, in the sway control table 121, the sway control information for the paper conveyance condition.

FIG. 7 shows an example of the sway control table 121. FIG. 7 shows, as an example, the sway control table 121 where the sway control information used at each of the sway timings (timings 1 to n) for each paper type is stored.

The storage 12 in the second embodiment also stores a program to perform a sway control process B described below.

Except the above, the configuration in the second embodiment is the same as that described in the first embodiment, and hence the description is not repeated here. Hereinafter, operation in the second embodiment is described.

Figure 8:
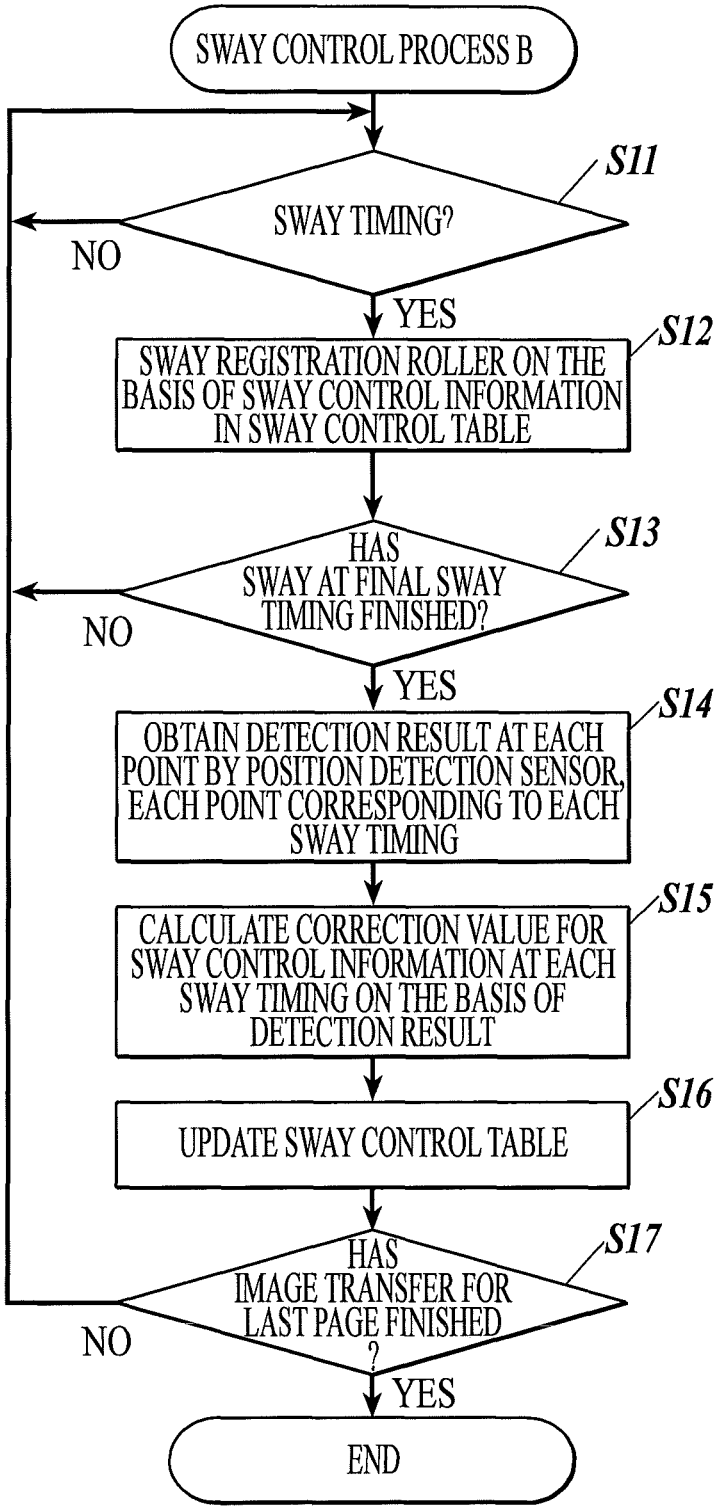
FIG. 8 is a flowchart showing a sway control process B that is performed in a second embodiment by the controller shown in FIG. 4.

FIG. 8 is a flowchart showing the sway control process B of the registration roller pair 27 that is performed in the second embodiment by the controller 11. The process shown in this flowchart is performed by the controller 11 in cooperation with the program stored in the storage 12 in response to a job execution instruction from a user.

When a job is started, the controller 11 waits for a sway timing of the registration roller pair 27 to come (Step S11). In this embodiment, the sway timing(s) is determined on the basis of the elapsed time since detection of the top of the paper P by the registration sensor 61. The controller 11, therefore, determines whether or not the sway timing has come on the basis of the elapsed time since detection of the top of the paper P by the registration sensor 61.

When determining that the sway timing has come (Step S11; YES), the controller 11 causes the drive mechanism 34 to sway the registration roller pair 27 on the basis of the sway control information for the sway timing and the paper conveyance condition identified in the sway control table 121 (Step S12).

The controller 11 repeats Steps S11 to S13 until the sway of the registration roller pair 27 at the final sway timing finishes, thereby causing the drive mechanism 34 to sway the registration roller pair 27 at each sway timing. During the time, when the paper P arrives at the position detection sensor 62, the position detection sensor 62, for each line, obtains the image information showing the position of the side edge of the paper P and the position of the toner image on the paper P, and outputs the same to the controller 11.

When determining that the sway of the registration roller pair 27 at the final sway timing has finished (Step S13; YES), the controller 11 obtains the detection result at each point by the position detection sensor 62, each point corresponding to each sway timing (Step S14). For example, the controller 11 identifies the region of the paper P and the region of the toner image from the detection result (image information) by the position detection sensor 62, and obtains the position of the side edge of the paper P and the position of the toner image on the paper P at each point in the sub-scanning direction of the paper P corresponding to each sway timing.

Next, the controller 11 calculates a correction value for the sway control information at each sway timing on the basis of the obtained detection result by the position detection sensor 62 (Step S15). For example, the controller 11 obtains distance between the position of the side edge of the paper P and the position of the toner image on the paper P at each point in the sub-scanning direction of the paper P corresponding to each sway timing (each point swayed at each sway timing). Then, for example, the controller 11 calculates, as the deviation amount, a difference between (i) each obtained distance and (ii) its ideal distance, namely, distance between the side edge of the paper P and the toner image on the paper P when the toner image is written at the image's optimum position, and determines the correction value for the sway control information at each sway timing on the basis of the calculated deviation amount.

Then, the controller 11 corrects the sway control information on the basis of the correction value calculated for each sway timing and thereby updates the sway control table 121 (Step S16). That is, the controller 11 overwrites the (pieces of) sway control information for the respective sway timings and the paper conveyance condition in the sway control table 121 with the (pieces of) sway control information corrected with the calculated correction values, and causes the storage 12 to store the overwritten sway control table 121.

If the sub-scanning curving occurs, deviation of the image position on the paper P tends to be larger on the bottom side of the paper P. In particular, in the paper that is long in the paper conveying direction, such as the long paper, the deviation is significant. In the sway control process B, the controller 11 calculates, on the basis of the detection result of the position of the side edge of the paper P and the position of the toner image on the paper P by the position detection sensor 62 after the image transfer, the deviation amount in a positional relationship between the side edge of the paper P and the toner image on the paper P (the deviation amount from the optimum positional relationship) at each point in the sub-scanning direction corresponding to each sway timing, and corrects, on the basis of the calculated deviation amount, the sway control information on the registration roller pair 27 at each sway timing and thereby updates the sway control table 121. This makes it possible to correct each sway control information for each sway timing, and accordingly suppress, with high accuracy, deviation of the image position on the paper P caused by the sub-scanning curving, starting from the next sheet of the paper P. This effect is significant on the paper that is long in the paper conveying direction, such as the long paper, in particular.

Next, the controller 11 determines whether or not the image transfer for the last page has finished (Step S17).

When determining that the image transfer for the last page has not finished yet (Step S17; NO), the controller 11 returns to Step S11.

On the other hand, when determining that the image transfer for the last page has finished (Step S17; YES), the controller 11 ends the sway control process B.

The above sway control process B is a process of correcting, on the basis of the sway of the registration roller pair 27, the sway control information to be used for the subsequent sway control(s) (for the subsequent sheet(s)), the sway control process B being performed during execution of a job. The image forming apparatus 100, however, has the adjustment mode, and in the adjustment mode, can set the sway control information to the sway control table 121 or correct the sway control information in the sway control table 121 in advance, namely, before execution of a job. For example, when an instruction for operation in the adjustment mode is input through the operation unit 14, the controller 11 lets a predetermined number of sheets of the paper P be fed from the paper feeding tray 21 or the paper feeding tray of the paper feeding apparatus, causes the image forming units 10Y, 10M, 10C, 10K to form toner images on the basis of image data stored in advance in the storage 12, and causes the secondary transfer roller pair 9 to transfer the toner images onto the sheets of the paper P. The controller 11 also performs the same control as the above sway control process B, and thereby causes the drive mechanism 34 to sway the registration roller pair 27, causes the position detection sensor 62 to detect the side edge of and the toner image on each of the sheets of the paper P onto which the toner images have been transferred, and sets the sway control information to the sway control table 121 or corrects the sway control information in the sway control table 121 on the basis of the detection results by the position detection sensor 62. Thus, the image forming apparatus 100 has the adjustment mode, and accordingly can set the sway control information to the sway control table 121 or correct the sway control information in the sway control table 121 in advance, namely, before execution of a job, and hence can suppress deviation of the image position on the paper P, starting from the first sheet of the paper P in a job and produce well-finished prints.

For example, in the second embodiment, each time an image for one page is transferred onto the paper P, the position detection sensor 62 obtains the detection result of the position of the side edge of the paper P and the position of the toner image on the paper P, and the controller 11 corrects the sway control information on the basis of the detection result in real time. Alternatively, the controller 11 may correct the sway control information on the basis of an arithmetic value of the detection results (e.g. the mean of deviation amounts, the median thereof, etc.) for a predetermined period (i.e. of a plurality of sheets onto which images have been transferred). This makes it possible to efficiently correct the sway control information on the basis of a trend during the predetermined period.

Further, in the sway control process B, during execution of a job, the controller 11 corrects, on the basis of the detection result of one sheet of the paper P by the position detection sensor 62, the sway control information that is used for the sway control of the registration roller pair 27 for the next sheet. Alternatively, the controller 11 may correct the sway control information that is used for the sway control of the registration roller pair 27 for the bottom side of the one sheet itself of the paper P. For example, in the case of the paper that is long in the paper conveying direction, such as the long paper (i.e. long sheets), when the position detection sensor 62 detects the position of the side edge of and the position of the toner image on a predetermined size of a sheet from the top of the sheet, the controller 11 may calculate the correction value for the sway control information on the basis of the detection result, correct the sway control information with the calculated correction value, and control the registration roller pair 27 for the bottom side of the sheet itself on the basis of the corrected sway control information.

Further, in the sway control process B, with the correction values calculated in Step S15, the (pieces of) sway control information in the sway control table 121 is rewritten. Alternatively, the storage 12 may store a correction value table where correction values for the sway timings and the paper conveyance condition are stored. Then, the controller 11 may write the correction values calculated in Step S15 in the correction value table for the sway timings and the paper conveyance condition, and perform the sway control of the registration roller pair 27 on the basis of the sway control information that is in the sway control table 121 and based on the correction value(s) in the correction value table when performing the sway control of the registration roller pair 27 next time.

As described above, the image forming apparatus 100 includes: the position detection sensor 62 that is provided on the downstream side of the secondary transfer roller pair 9 but on the upstream side of the fixing device 50 and detects the position of a side edge of the paper P; and the controller 11 that performs the sway control of the registration roller pair 27 on the basis of the detection result by the position detection sensor 62. For example, the controller 11 determines the sway control information on the registration roller pair 27 on the basis of the detection result by the position detection sensor 62, and performs the sway control of the registration roller pair 27 on the basis of the determined sway control information.

Thus, the image forming apparatus 100 makes the registration roller pair 27 sway on the basis of the actual position of the side edge of the paper P after the image transfer, thereby adjusting the position of the side edge of the paper P while the paper P is passing through the registration roller pair 27. This can suppress, with high accuracy, deviation of the toner image position on the paper P caused by the sub-scanning curving.

Further, the position detection sensor 62 is provided over, of the conveyance path, the side where the toner image is transferred onto the paper (i.e. the imaging side), and the controller 11 determines the sway control information on the basis of the position of the side edge of the paper P and the position of the toner image on the paper P detected by the position detection sensor 62. This can suppress, with higher accuracy, deviation of the toner image position on the paper P caused by the sub-scanning curving on the basis of the deviation amount in the positional relationship between the side edge of the paper P and the toner image on the paper P.

Further, the controller 11 determines the sway control information for the paper conveyance condition, such as the paper type and/or the environment. This enables the optimum sway control for the paper conveyance condition.

Further, the controller 11 determines, for each of predetermined multiple timings at which the registration roller pair 27 is swayed, the sway control information on the basis of the detection result by the position detection sensor 62. This can suppress, with higher accuracy, deviation of the toner image position on the paper P caused by the sub-scanning curving.

Third Embodiment

Next, a third embodiment of the present invention is described.

As described above, the conventional technology of detecting the position of a side edge of paper before the paper passes through a secondary transfer roller pair and swaying a registration roller pair on the basis of the detection result may not suppress, with high accuracy, deviation of the image position on the paper caused by the sub-scanning curving, which is a phenomenon of paper being curved in the paper conveying direction (the sub-scanning direction) from somewhere on the paper, for example, by misalignment of the registration roller pair, the secondary transfer roller pair and a fixing roller pair or by difference between roller diameters of the front/near side and the back/far side of each roller when the image forming apparatus is viewed from the front. In particular, the fixing roller pair has high conveyance power, and hence the image fixing tends to cause the sub-scanning curving, which causes deviation of the image position on paper.

In the third embodiment, the position detection sensor 62 is provided on the downstream side of the fixing device 50 in order to suppress deviation of the image position on the paper P caused by the sub-scanning curving. To simplify explanations, the same components as those of the first embodiment are given the same reference numbers, and the detailed description is not repeated here.

[Configuration of Image Forming Apparatus 100A]

First, configuration of an image forming apparatus 100A according to the third embodiment is described.

Figure 9:
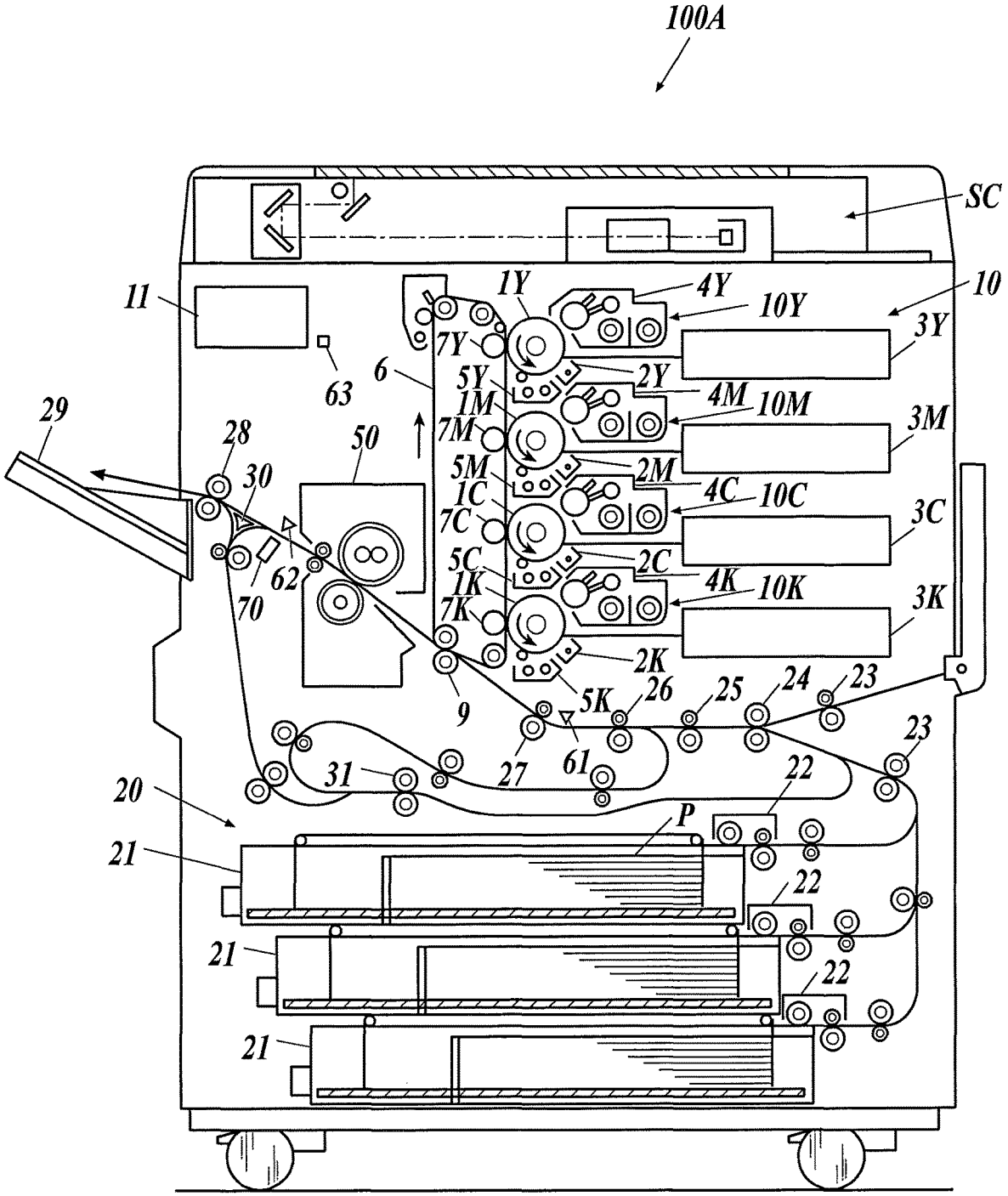
FIG. 9 schematically shows configuration of an image forming apparatus according to a third embodiment of the present invention.
Figure 10:
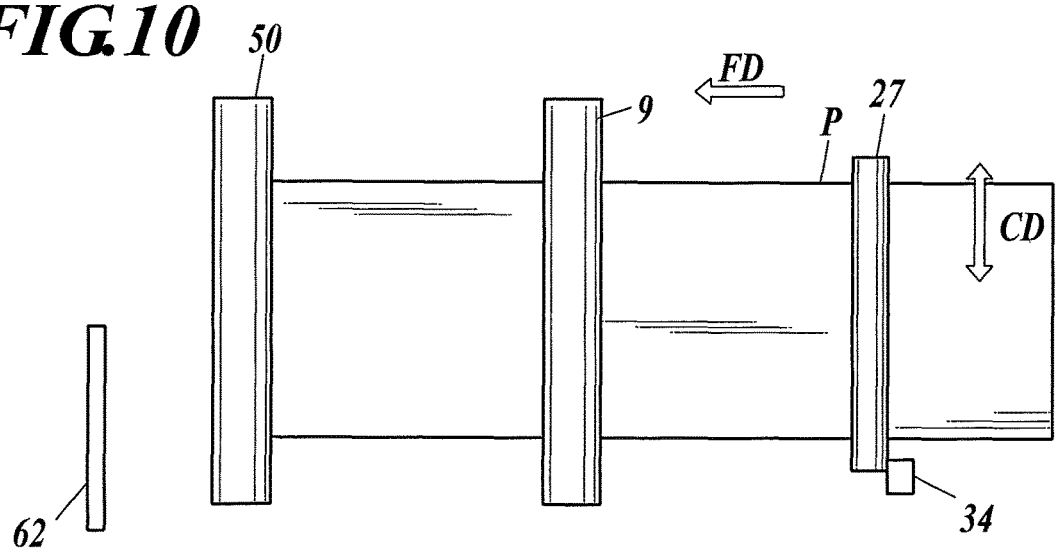
FIG. 10 shows arrangement of the position detection sensor and the sway process of paper by the registration roller pair from the above.
Figure 11:
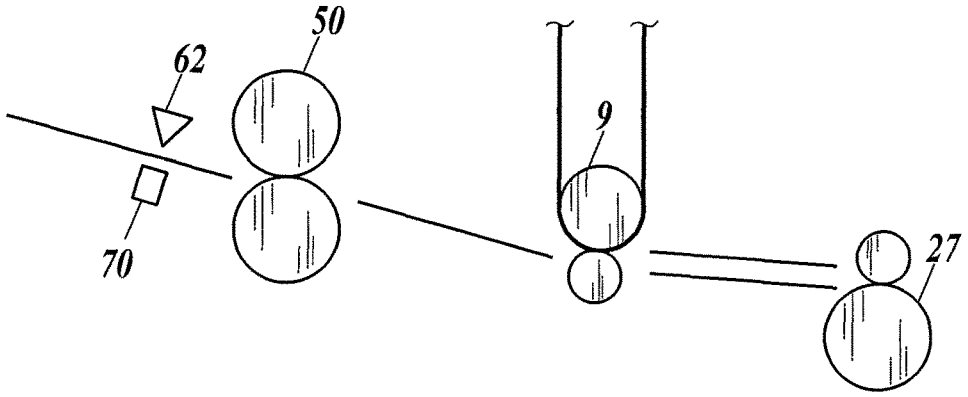
FIG. 11 shows arrangement of the position detection sensor and the suction fan.

As shown in FIG. 9 to FIG. 11, the position detection sensor 62 is provided on the downstream side of the fixing device 50 over the imaging side. The position detection sensor 62 includes a linear image sensor (e.g. a CCD line sensor) in which light receiving elements are arranged linearly along the paper width direction CD, an optical system and a light source. The position detection sensor 62 is a detector that detects the position of a side edge of the paper P in the paper width direction CD after the image fixing. In this embodiment, the position detection sensor 62 reads the paper P from above the imaging side, and accordingly can detect the position of the toner image transferred onto the paper P. The detection result by the position detection sensor 62 is output to the controller 11, and used for determination of the sway control information on the registration roller pair 27 used for the sway process, and so forth.

As shown in FIG. 11, the suction fan 70 is provided under the conveyance path in such a way as to face the position detection sensor 62 on the downstream side of the fixing device 50. For example, vent hole(s) are made in the lower guide (conveyor belt) of the conveyance path, and suction is performed by the suction fan 70, so that the paper P can be conveyed along and on the lower guide. This can prevent the toners on the paper P from adhering to the position detection sensor 62. Further, the above makes it possible to arrange the position detection sensor 62 near the imaging side and accordingly increase the detection accuracy.

[Operation of Image Forming Apparatus 100A]

Next, operation of the image forming apparatus 100A in the third embodiment is described. The operation of the image forming apparatus 100A in the third embodiment is the same as that of the image forming apparatus 100 in the first embodiment (the sway control process A shown in FIG. 5), and hence the detailed description is not repeated here.

Figure 12:
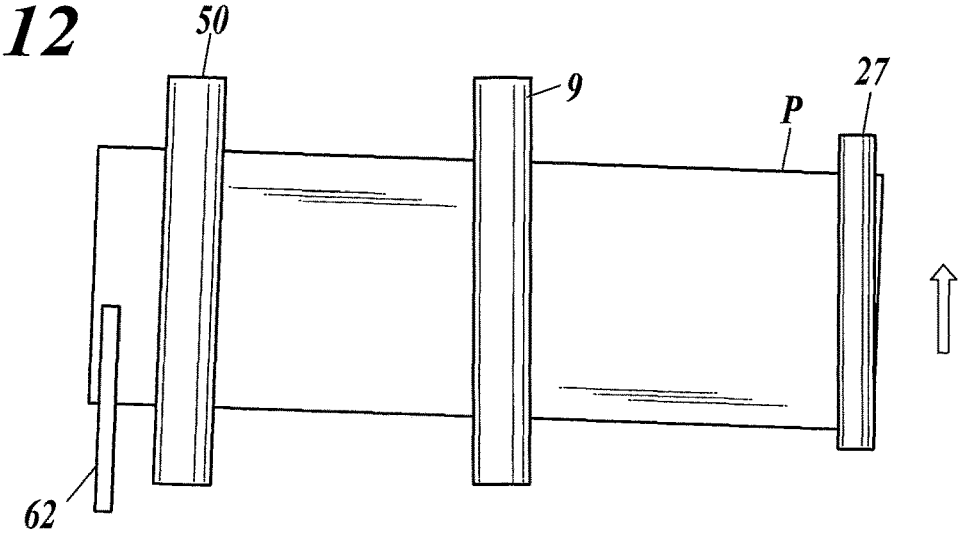
FIG. 12 shows an example of the sub-scanning curving.

Because the fixing device 50 has high conveyance power, the paper P may be curved from somewhere on the paper P, for example, by misalignment of the fixing device 50 and other components as shown in FIG. 12. As a result of that, the position of the paper P with respect to the transfer position of the secondary transfer roller pair 9 deviates, and hence a toner image(s) cannot be transferred to the optimum position (hereinafter "image's optimum position", for example, the position where the center in the width direction of the paper P matches the center in the width direction of the toner image). In this embodiment, the position detection sensor 62 provided on the downstream side of the fixing device 50 detects the position of the side edge of the paper P, and the controller 11 makes the registration roller pair 27 sway on the basis of the detection result, thereby adjusting the position of the side edge of the paper P, and accordingly can suppress deviation of the position of the paper P with respect to the transfer position caused by the fixing device 50. For example, in the case shown in FIG. 12, the registration roller pair 27 is swayed (moved) in a direction indicated by an arrow.

Thus, in the third embodiment, the position detection sensor 62 is provided on the downstream side of the fixing device 50, and on the basis of the detection result (the position of the side edge of the paper P and/or the position of the toner image on the paper P) on the top side of the paper P by the position detection sensor 62, the controller 11 controls the sway of the registration roller pair 27 on the bottom side of the paper P. This can suppress deviation of the toner image position on the paper P caused by the sub-scanning curving of the paper P caused by the fixing device 50.

Fourth Embodiment

Next, a fourth embodiment of the present invention is described.

In the fourth embodiment, on the basis of the detection result by the position detection sensor 62 provided on the downstream side of the fixing device 50, the sway control information on the registration roller pair 27 for the subsequent sheet(s) of the paper P is determined. Operation of the image forming apparatus 100A in the fourth embodiment is the same as that of the image forming apparatus 100 in the second embodiment (the sway control process B shown in FIG. 8), and hence the detailed description is not repeated here.

Because the fixing device 50 has high conveyance power, deviation of the toner image position on the paper P tends to be larger on the bottom side of the paper P, the bottom side where the toner image is transferred after the top of the paper P arrives at the fixing device 50. In the sway control process B, the controller 11 calculates, on the basis of the detection result of the position of the side edge of the paper P and the position of the toner image on the paper P by the position detection sensor 62 after the paper P passes through the fixing device 50, the deviation amount in the positional relationship between the side edge of the paper P and the toner image on the paper P (the deviation amount from the optimum positional relationship) at each point in the sub-scanning direction corresponding to each sway timing, and corrects, on the basis of the calculated deviation amount, the sway control information at each sway timing and thereby updates the sway control table 121. This makes it possible to correct each sway control information for each sway timing on the basis of the deviation at each point in the sub-scanning direction, and accordingly suppress, with high accuracy, deviation of the image position on the paper P caused by the sub-scanning curving, starting from the next sheet of the paper P.

As described above, the image forming apparatus 100A includes: the position detection sensor 62 that is provided on the downstream side of the fixing device 50 and detects the position of a side edge of the paper P; and the controller 11 that performs the sway control of the registration roller pair 27 on the basis of the detection result by the position detection sensor 62. For example, the controller 11 determines the sway control information on the registration roller pair 27 on the basis of the detection result by the position detection sensor 62, and performs the sway control of the registration roller pair 27 on the basis of the determined sway control information.

Thus, the image forming apparatus 100A makes the registration roller pair 27 sway on the basis of the position of the side edge of the paper P after the image fixing, thereby adjusting the position of the side edge of the paper P while the paper P is passing through the registration roller pair 27. This can suppress, with high accuracy, deviation of the toner image position on the paper P caused by the sub-scanning curving due to the fixing device 50.

Fifth Embodiment

Next, a fifth embodiment of the present invention is described.

The conventional technology adopts the configuration in which a line sensor is arranged on the downstream side of a registration roller pair but on the upstream side of a secondary transfer roller pair, and accordingly can obtain only the measurement result containing variation in the paper conveyance caused by the registration roller pair. That is, the conventional technology cannot measure variation in the paper conveyance caused by conveying roller pairs (paper feeding unit/ADU (automatic double-sided unit)) arranged on the upstream side of the registration roller pair, and accordingly cannot suppress variation in the paper conveyance caused by the conveying roller pairs arranged on the upstream side of the registration roller pair.

In the fifth embodiment, the position detection sensor 62 is arranged on the upstream side of the registration roller pair 27 in the paper conveying direction, and the controller 11 makes the registration roller pair 27 sway on the basis of the detection result by the position detection sensor 62 and predetermined sway control information. This can suppress variation in the paper conveyance caused by the conveying roller pairs arranged on the upstream side of the registration roller pair 27. To simplify explanations, the same components as those of the first embodiment are given the same reference numbers, and the detailed description is not repeated here.

[Configuration of Image Forming Apparatus 100B]

First, configuration of an image forming apparatus 100B according to the fifth embodiment is described.

Figure 13:
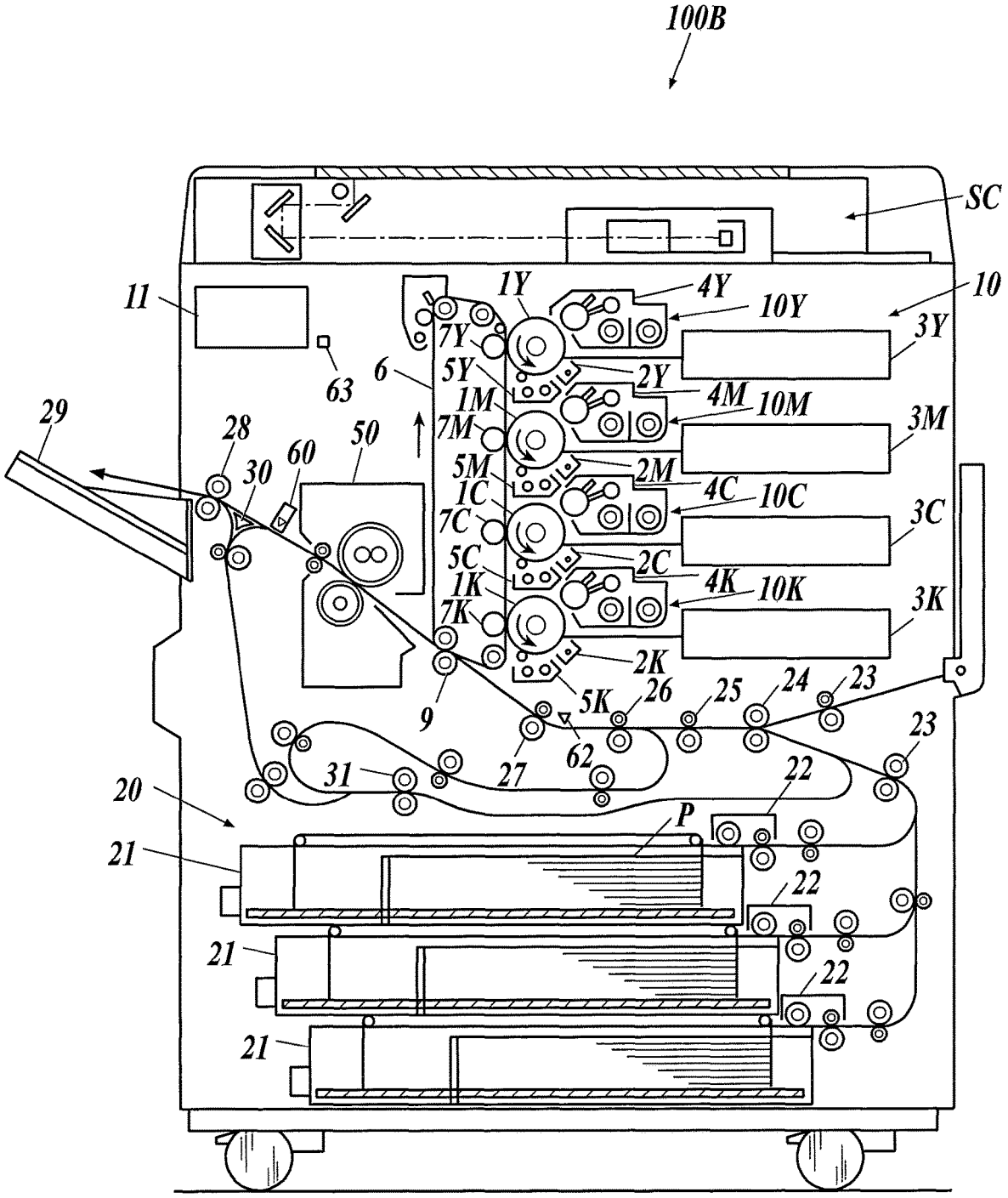
FIG. 13 schematically shows configuration of an image forming apparatus according to a fifth embodiment of the present invention.

As shown in FIG. 13, the image forming apparatus 100B includes the document scanner SC, the image former 10, the fixing device 50, an image reader 60 and the controller 11 as main components, and these components are housed in one casing.

Figure 14:
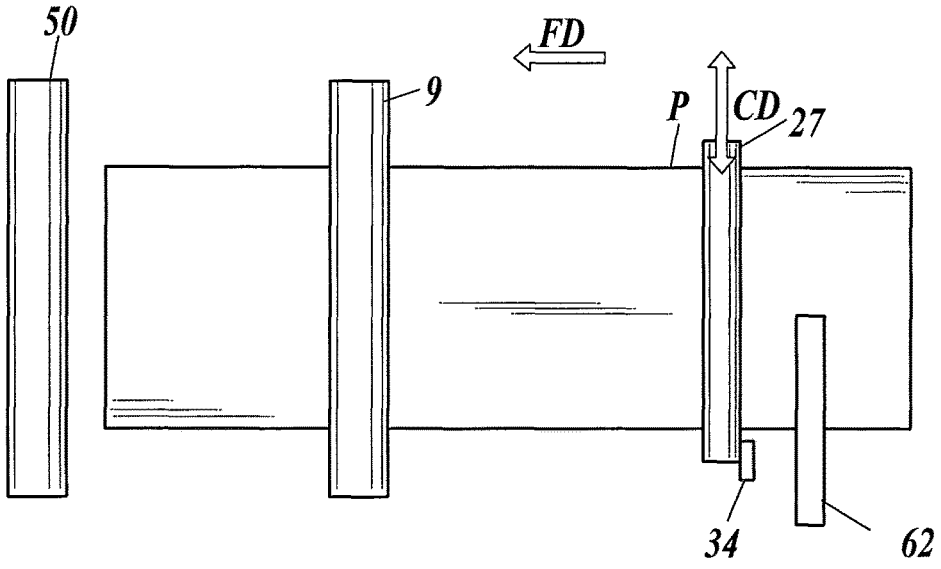
FIG. 14 shows arrangement of the position detection sensor and the sway process of paper by the registration roller pair from the above.

As shown in FIG. 14, the position detection sensor 62 is arranged between the registration roller pair 27 and the loop roller pair 26 over the conveyance path. The position detection sensor 62 detects arrival of the top of the paper P at a detection position of the position detection sensor 62 (a position a predetermined distance before the registration roller pair 27). This detection result by the position detection sensor 62 is used for detection of the rotation start timing of the registration roller pair 27, determination of the sway control information on the registration roller pair 27 used for the sway process, grasping of an arrival timing at which the top of the paper P arrives at the transfer nip part (i.e. a timing at which the top of the paper P enters the secondary transfer roller pair 9), and so forth.

The paper P subjected to the fixing process by the fixing device 50 is read by the image reader (ICCU) 60, and then ejected by the paper ejection roller pair 28 onto the paper receiving tray 29 attached to the outer lateral surface of the casing.

The image reader 60 includes, for example, a linear image sensor (e.g. a CCD line sensor, etc.), an optical system and a light source, and reads the paper P onto which the toner image has been transferred, and outputs the obtained read image to the controller 11. In the fifth embodiment, the image reader 60 is one that can measure colors of the toner image on the paper P, but not particularly limited as far as it can recognize the region of the paper P and the region of the toner image. Further, in the fifth embodiment, the image reader 60 is arranged on the downstream side of the fixing device 50 but in front of where the conveyance path is switched by the switching gate 30. However, the arrangement position of the image reader 60 is not particularly limited as far as it is on the downstream side of the secondary transfer roller pair 9 (transfer nip part) and where the image reader 60 can read both sides of the paper P (may read one side for each time). Needless to say, an optional apparatus as the image reader 60 may be arranged on the downstream side of the image forming apparatus 100B.

Figure 15:
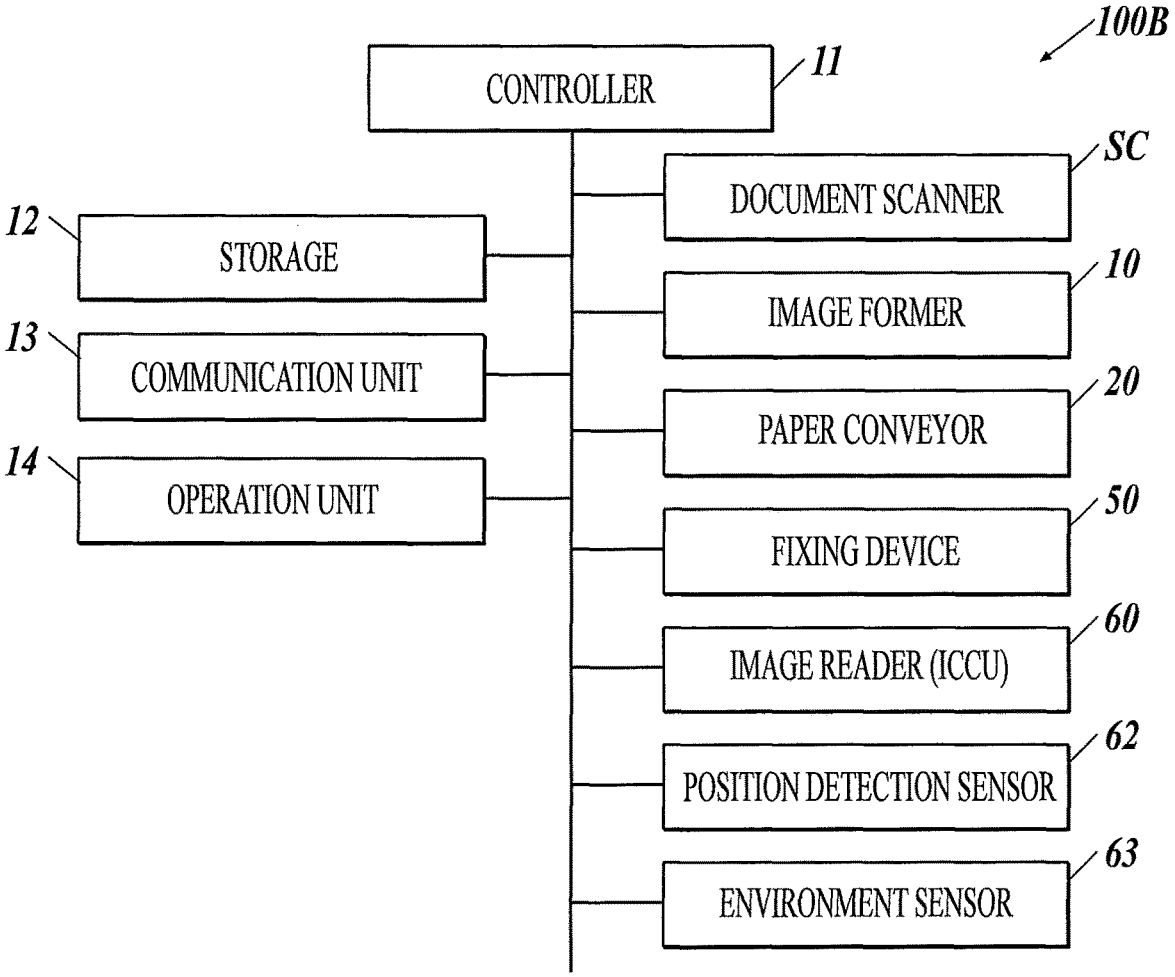
FIG. 15 is a block diagram schematically showing configuration of a control system of the image forming apparatus shown in FIG. 13.

FIG. 15 is a block diagram schematically showing configuration of a control system of the image forming apparatus 100B according to the fifth embodiment.

As shown in FIG. 15, the controller 11 is connected to the storage 12, the communication unit 13, the operation unit 14, the document scanner SC, the image former 10, the paper conveyor 20, the fixing device 50, the image reader 60, the position detection sensor 62 and the environment sensor 63.

[Operation of Image Forming Apparatus 100B]

Next, operation of the image forming apparatus 100B in the fifth embodiment is described.

In the fifth embodiment, the controller 11 of the image forming apparatus 100B performs a process to sway the registration roller pair 27 on the basis of the detection result by the position detection sensor 62 and the predetermined sway control information. In this embodiment, the sway control information is the sway amount, the sway direction (+, −) and the sway speed.

In the image forming apparatus 100B of the fifth embodiment, on the basis of the detection result by the position detection sensor 62 and the predetermined sway control information, the registration roller pair 27 moves along the paper width direction CD during the passing period during which the paper P passes through the registration roller pair 27, thereby moving the paper P, which is being conveyed, along the paper width direction CD (sway process).

In the fifth embodiment, as shown in FIG. 14, the position detection sensor 62, which detects the position of the side edge of the paper P, is arranged on the upstream side of the registration roller pair 27 in the paper conveying direction FD (to be specific, between the registration roller pair 27 and the loop roller pair 26).

This makes it possible to detect the position of the side edge of the paper P before the paper P enters the registration roller pair 27, and accordingly detect variation in the paper conveyance caused by the conveying roller pairs (paper feeding unit/ADU (automatic double-sided unit)) arranged on the upstream side of the registration roller pair 27. Then, it becomes possible to sway the registration roller pair 27 on the basis of the detected variation (detection result) and the predetermined sway control information. This can suppress variation in the paper conveyance caused by the conveying roller pairs arranged on the upstream side of the registration roller pair 27.

Variation in the position of the side edge of the paper changes depending on the paper conveyance condition (a predetermined condition(s) that affects the paper conveyance). Hence, by taking the change in the variation in the position of the side edge of the paper P into account, the sway control information (the sway amount, the sway direction (+, −) and the sway speed) should be different according to the paper conveyance condition. Examples of the paper conveyance condition include the paper type of the paper P, the basis weight of the paper P, the environment (temperature, humidity, etc.), and the paper size (paper width, paper length, etc.) of the paper P. For example, if the paper type of the paper P is thin paper, the paper P is more easily curved as compared with plain paper or thick paper, and accordingly, for example, the sway amount needs to be larger.

In the fifth embodiment, the storage 12 stores the sway control table 121 (shown in FIG. 7) where the sway control information for the paper conveyance condition (to be specific, for each paper type) is stored. That is, the sway control information is determined for the paper conveyance condition.

In the fifth embodiment, the registration roller pair 27 is controlled to sway at predetermined multiple timings (hereinafter "sway timings"), and in the sway control table 122, the sway control information used at each of the sway timings (timings 1 to n) is stored. In order to write a toner image(s) at the image's optimum position on the paper P with high accuracy, it is preferable to store, in the sway control table 122, the sway control information used at each of the sway timings (timings 1 to n) for each paper type, each basis weight, each environment, each paper size or each combination of these.

As described above, storing the sway control table 121 in the storage 12 makes it possible to appropriately determine the sway control information for the paper conveyance condition.

In the fifth embodiment, the image forming apparatus 100B has the adjustment mode, and in the adjustment mode, can set the correction values to the sway control table 121 or correct the correction values in the sway control table 121 in advance, namely, before execution of a job. For example, when an instruction for operation in the adjustment mode is input through the operation unit 14, the controller 11 lets a predetermined number of sheets of the paper P be fed from the paper feeding tray 21 or the paper feeding tray of the paper feeding apparatus, causes the image forming units 10Y, 10M, 10C, 10K to form toner images on the basis of image data stored in advance in the storage 12, and causes the secondary transfer roller pair 9 to transfer the toner images onto the sheets of the paper P. Also, after causing the drive mechanism 34 to sway the registration roller pair 27, the controller 11 causes the position detection sensor 62 to detect the position of the side edge of each of the sheets of the paper P onto which the toner images have been transferred, calculates the correction values for the sway control information on the basis of the detection results by the position detection sensor 62, and sets the calculated correction values to the sway control table 121 or corrects the correction values in the sway control table 121 with the calculated correction values. Thus, the image forming apparatus 100B has the adjustment mode, and accordingly can set the correction values to the sway control table 121 or correct the correction values in the sway control table 121 in advance, namely, before execution of a job, and hence can suppress deviation of the image position on the paper P, starting from the first sheet of the paper P in a job and produce well-finished prints.

[Specific Examples for Sway Process]

As described above, the sway process in the fifth embodiment is performed by the sway of the registration roller pair 27. That is, on the basis of the detection result by the position detection sensor 62 and the predetermined sway control information, the registration roller pair 27 moves along the paper width direction CD during the passing period during which the paper P passes through the registration roller pair 27, thereby moving the paper P, which is being conveyed, along the paper width direction CD.

An example of how to realize the sway process in the fifth embodiment is a process (first sway control process) of causing the position detection sensor 62 to detect the position of the side edge of the paper P, determining distance/difference between the position of the side edge of the paper P and the target position (or corrected target position if correction thereof has been performed) (the sway amount of the registration roller pair 27) on the basis of the detection result, and making the registration roller pair 27 sway on the basis of the determined sway amount.

Another example of how to realize the sway process in the fifth embodiment is a process (second sway control process) of, after making the registration roller pair 27 sway in the paper width direction CD, determining on the basis of the detection result by the position detection sensor 62 whether or not the side edge of the paper P has reached the target position (or corrected target position if correction thereof has been performed), and when determining that the side edge of the paper P has reached the target position, making the registration roller pair 27 stop swaying.

In the fifth embodiment, either of the sway control processes can be performed. Alternatively, the first sway control process may be performed before the top of the paper P enters the secondary transfer roller pair 9, and the second sway control process may be performed after the top of the paper P enters the secondary transfer roller pair 9, for example.

As described above, the image forming apparatus 100B of the fifth embodiment includes: the registration roller pair 27 (sway roller pair) constituted of a pair of rollers that conveys the paper P to the secondary transfer roller pair 9 (transfer unit), the paper P being conveyed to the registration roller pair 27; the position detection sensor 62 (detector) that is provided on the upstream side of the registration roller pair 27 in the paper conveying direction and detects the position of a side edge of the paper P; and the controller 11 that makes the registration roller pair 27 sway on the basis of the detection result by the position detection sensor 62 and predetermined sway control information.

Hence, the image forming apparatus 100B of the fifth embodiment can detect variation in the paper conveyance caused by the conveying roller pairs (paper feeding unit/ADU (automatic double-sided unit)) arranged on the upstream side of the registration roller pair 27, and accordingly suppress variation in the paper conveyance caused by the conveying roller pairs arranged on the upstream side of the registration roller pair 27.

Further, according to the image forming apparatus 100B of the fifth embodiment, the sway control information is determined for the paper conveyance condition.

Hence, according to the image forming apparatus 100B of the fifth embodiment, the sway control information can be determined for each paper conveyance condition. This can suppress, with higher accuracy, variation in the paper conveyance.

Further, the image forming apparatus 100B of the fifth embodiment further includes the storage 12 that stores the sway control table 121 where the sway control information for the paper conveyance condition is stored.

Hence, according to the image forming apparatus 100B of the fifth embodiment, the sway control information can be determined for each paper conveyance condition and stored. This can suppress, with higher accuracy, variation in the paper conveyance.

The matters described in the above embodiments are merely some of preferred examples of the image forming apparatus of the present invention, and not intended to limit the present invention.

For example, in the first embodiment, the position detection sensor 62, which detects the position of the side edge of the paper P, is provided on the downstream side of the secondary transfer roller pair 9 but on the upstream side of the fixing device 50 only. Alternatively, a plurality of position detection sensors may be provided over the conveyance path, and the controller 11 may determine the sway control information on the basis of each detection result or the detection results by the plurality of the position detection sensors together.

Figure 16:
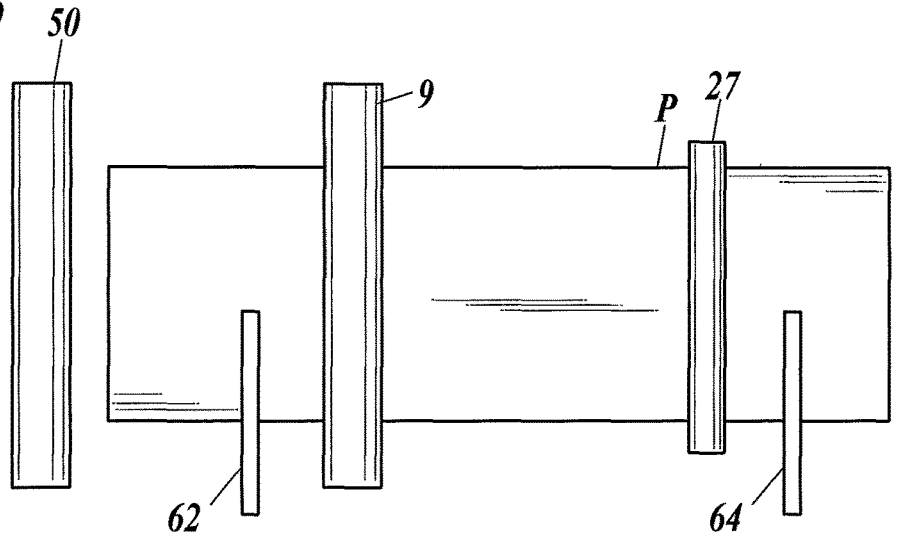
FIG. 16 shows an example of arrangement of the position detection sensors.

For example, as shown in FIG. 16, in addition to the position detection sensor 62 provided on the downstream side of the secondary transfer roller pair 9 but on the upstream side of the fixing device 50, a position detection sensor 64 (second detector) may be provided on the upstream side of the registration roller pair 27. Then, for example, when the position detection sensor 64 detects the side edge of the paper P, the controller 11 may determine the sway control information on the registration roller pair 27 on the basis of the detection result (e.g. on the basis of the deviation amount from the target position) and make the registration roller pair 27 sway on the basis of the determined sway control information, and thereafter, when the position detection sensor 62 detects the side edge of the paper P, the controller 11 may determine the sway control information, for example, by the method described in the first embodiment and make the registration roller pair 27 sway on the basis of the determined sway control information. Alternatively, when the sway control information is determined in the first embodiment, the detection result by the position detection sensor 64 may be taken into account. Thus, providing the position detection sensor 64 on the upstream side of the registration roller pair 27 in addition to the position detection sensor 62 and making the registration roller pair 27 sway on the basis of the detection results by these position detection sensors 62, 64, thereby adjusting the position of the side edge of the paper P, can also suppress variation in the paper conveyance on the upstream side of the registration roller pair 27.

Figure 17:
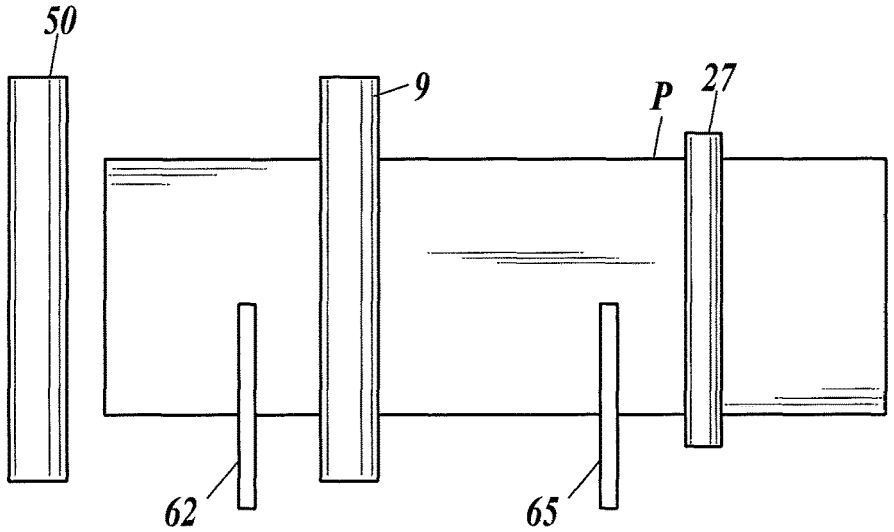
FIG. 17 shows an example of arrangement of the position detection sensors.

As another example, as shown in FIG. 17, in addition to the position detection sensor 62 provided on the downstream side of the secondary transfer roller pair 9 but on the upstream side of the fixing device 50, a position detection sensor 65 (third detector) may be provided on the downstream side of the registration roller pair 27 but on the upstream side of the secondary transfer roller pair 9. Then, for example, when the position detection sensor 65 detects the side edge of the paper P, the controller 11 may determine the sway control information on the registration roller pair 27 on the basis of the detection result (e.g. on the basis of the deviation amount from the target position) and make the registration roller pair 27 sway on the basis of the determined sway control information, and thereafter, when the position detection sensor 62 detects the side edge of the paper P, the controller 11 may determine the sway control information, for example, by the method described in the first embodiment and make the registration roller pair 27 sway on the basis of the determined sway control information. Alternatively, when the sway control information is determined in the first embodiment, the detection result by the position detection sensor 65 may be taken into account. Thus, providing the position detection sensor 65 on the downstream side of the registration roller pair 27 but on the upstream side of the secondary transfer roller pair 9 in addition to the position detection sensor 62 and making the registration roller pair 27 sway on the basis of the detection results by these position detection sensors 62, 65, thereby adjusting the position of the side edge of the paper P, can also suppress variation in the paper conveyance caused by the registration roller pair 27. Further, providing the position detection sensor 65 as close to the transfer unit as possible on the upstream side of the transfer unit makes it possible to match the position of the paper P with the transfer position (image forming position) accurately.

Figure 18:
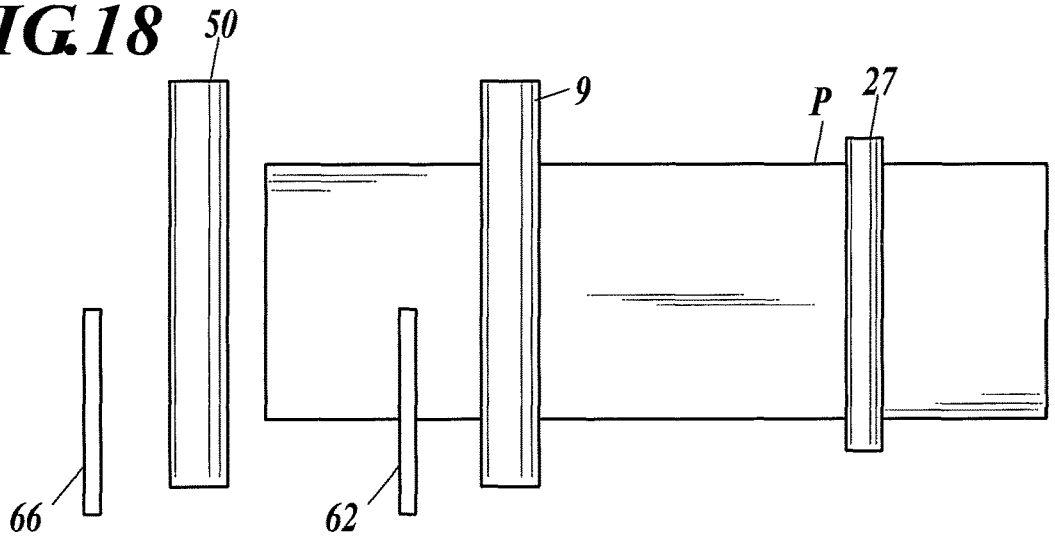
FIG. 18 shows an example of arrangement of the position detection sensors.

As another example, as shown in FIG. 18, in addition to the position detection sensor 62 provided on the downstream side of the secondary transfer roller pair 9 but on the upstream side of the fixing device 50, a position detection sensor 66 (fourth detector) may be provided on the downstream side of the fixing device 50. Then, for example, when the position detection sensor 62 detects the side edge of the paper P, the controller 11 may determine the sway control information on the registration roller pair 27 on the basis of the detection result and make the registration roller pair 27 sway on the basis of the determined sway control information, and thereafter, when the position detection sensor 66 detects the side edge of the paper P, the controller 11 may determine the sway control information on the basis of the detection result by the position detection sensor 66 and make the registration roller pair 27 sway on the basis of the determined sway control information. Alternatively, when the sway control information is determined in the first embodiment, the detection result by the position detection sensor 66 may be taken into account. Thus, providing the position detection sensor 66 on the downstream side of the fixing device 50 in addition to the position detection sensor 62 and making the registration roller pair 27 sway on the basis of the detection results by these position detection sensors 62, 66, thereby adjusting the position of the side edge of the paper P, can also suppress variation in the paper conveyance caused by the fixing device 50.

Further, in the third embodiment, the position detection sensor 62, which detects the position of the side edge of the paper P, is provided on the downstream side of the fixing device 50 only. Alternatively, a plurality of position detection sensors may be provided over the conveyance path, and the controller 11 may determine the sway control information on the basis of each detection result or the detection results by the plurality of the position detection sensors together.

Figure 19:
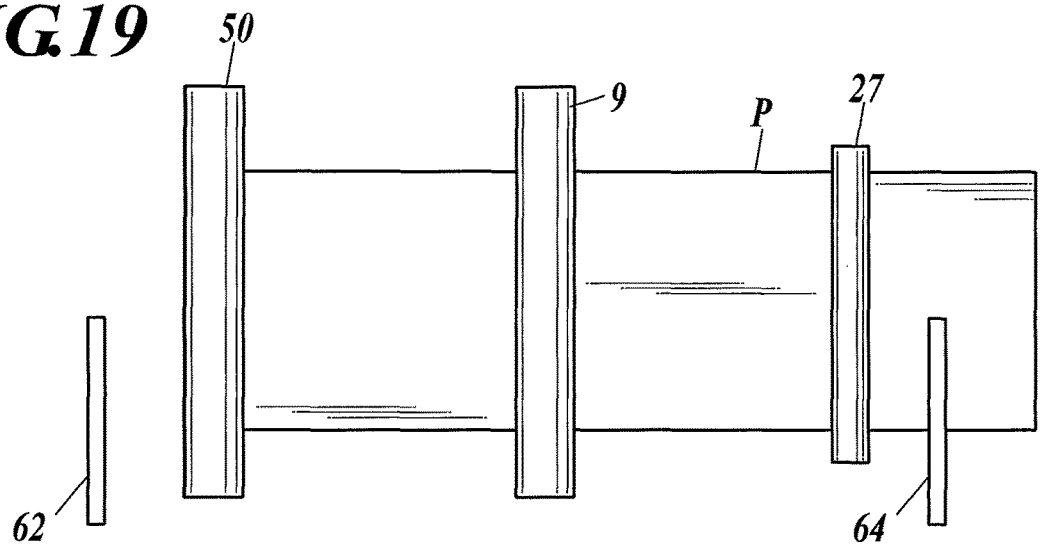
FIG. 19 shows an example of arrangement of the position detection sensors.

For example, as shown in FIG. 19, in addition to the position detection sensor 62 provided on the downstream side of the fixing device 50, a position detection sensor 64 (second detector) may be provided on the upstream side of the registration roller pair 27. Then, for example, when the position detection sensor 64 detects the side edge of the paper P, the controller 11 may determine the sway control information on the registration roller pair 27 on the basis of the detection result (e.g. on the basis of the deviation amount from the target position) and make the registration roller pair 27 sway on the basis of the determined sway control information, and thereafter, when the position detection sensor 62 detects the side edge of the paper P, the controller 11 may determine the sway control information, for example, by the method described in the third embodiment and make the registration roller pair 27 sway on the basis of the determined sway control information. Alternatively, when the sway control information is determined in the third embodiment, the detection result by the position detection sensor 64 may be taken into account. Thus, providing the position detection sensor 64 on the upstream side of the registration roller pair 27 in addition to the position detection sensor 62 and making the registration roller pair 27 sway on the basis of the detection results by these position detection sensors 62, 64, thereby adjusting the position of the side edge of the paper P, can also suppress variation in the paper conveyance on the upstream side of the registration roller pair 27.

Figure 20:
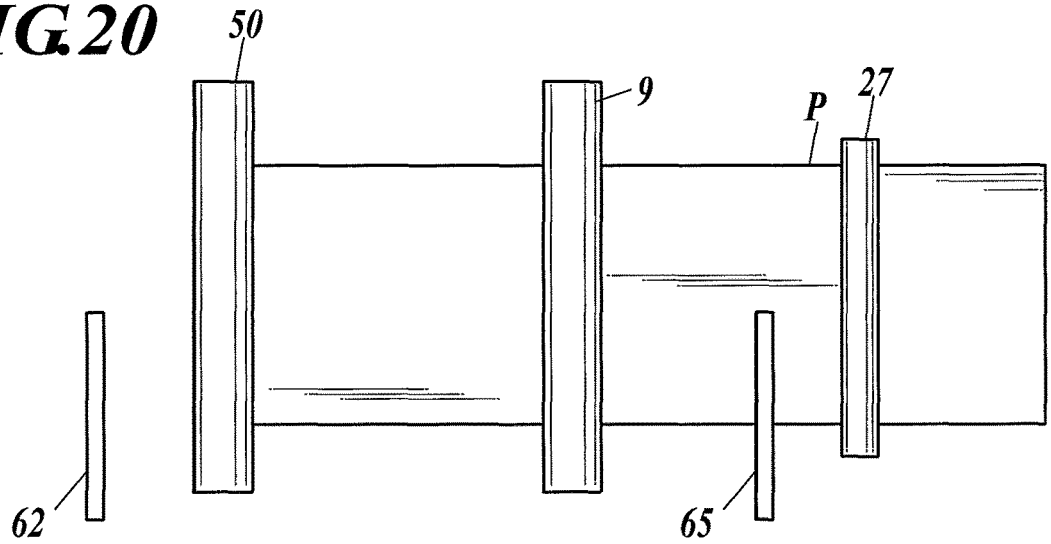
FIG. 20 shows an example of arrangement of the position detection sensors.

As another example, as shown in FIG. 20, in addition to the position detection sensor 62, a position detection sensor 65 (third detector) may be provided on the downstream side of the registration roller pair 27 but on the upstream side of the secondary transfer roller pair 9. Then, for example, when the position detection sensor 65 detects the side edge of the paper P, the controller 11 may determine the sway control information on the registration roller pair 27 on the basis of the detection result (e.g. on the basis of the deviation amount from the target position) and make the registration roller pair 27 sway on the basis of the determined sway control information, and thereafter, when the position detection sensor 62 detects the side edge of the paper P, the controller 11 may determine the sway control information, for example, by the method described in the third embodiment and make the registration roller pair 27 sway on the basis of the determined sway control information. Alternatively, when the sway control information is determined in the third embodiment, the detection result by the position detection sensor 65 may be taken into account. Thus, providing the position detection sensor 65 on the downstream side of the registration roller pair 27 but on the upstream side of the secondary transfer roller pair 9 in addition to the position detection sensor 62 and making the registration roller pair 27 sway on the basis of the detection results by these position detection sensors 62, 65, thereby adjusting the position of the side edge of the paper P, can also suppress variation in the paper conveyance caused by the registration roller pair 27. Further, providing the position detection sensor 65 as close to the transfer unit as possible on the upstream side of the transfer unit makes it possible to match the position of the paper P with the transfer position (image forming position) accurately.

Figure 21:
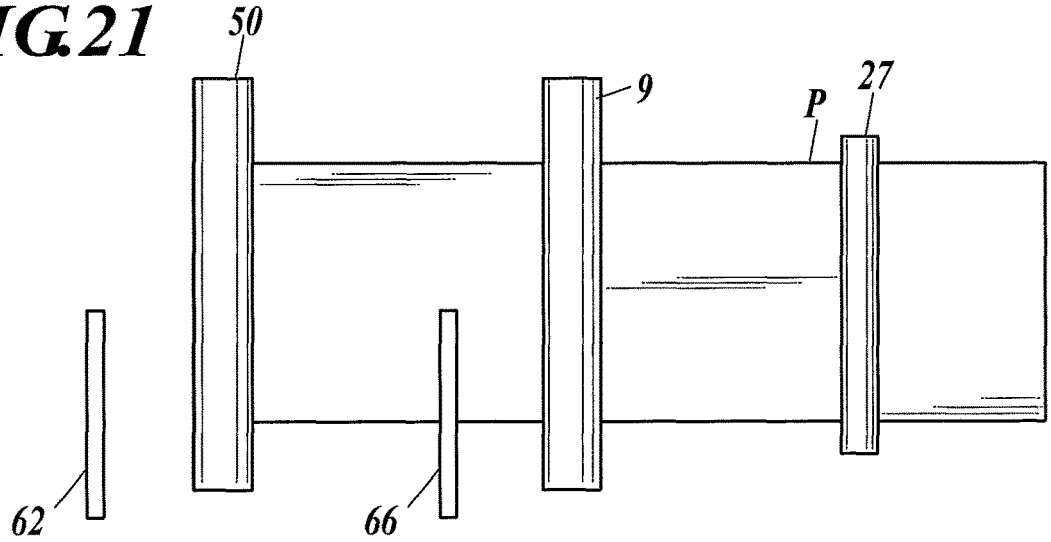
FIG. 21 shows an example of arrangement of the position detection sensors.

As another example, as shown in FIG. 21, in addition to the position detection sensor 62, a position detection sensor 66 (fourth detector) may be provided on the downstream side of the secondary transfer roller pair 9 but on the upstream side of the fixing device 50. Then, for example, when the position detection sensor 66 detects the side edge of the paper P, the controller 11 may determine the sway control information on the registration roller pair 27 on the basis of the detection result (e.g. on the basis of the deviation amount from the target position) and make the registration roller pair 27 sway on the basis of the determined sway control information, and thereafter, when the position detection sensor 62 detects the side edge of the paper P, the controller 11 may determine the sway control information on the basis of the detection result by the position detection sensor 62 and make the registration roller pair 27 sway on the basis of the determined sway control information. Alternatively, when the sway control information is determined in the third embodiment, the detection result by the position detection sensor 66 may be taken into account. Thus, providing the position detection sensor 66 on the downstream side of the secondary transfer roller pair 9 but on the upstream side of the fixing device 50 in addition to the position detection sensor 62 can also suppress variation in the paper conveyance caused by the secondary transfer roller pair 9. Further, providing the position detection sensor 66 as close to the transfer unit as possible on the downstream side of the transfer unit makes it possible to match the position of the paper P with the transfer position (image forming position) accurately.

Further, in the fifth embodiment, the position detection sensor 62 is arranged between the registration roller pair 27 and the loop roller pair 26 (shown in FIG. 13, etc.). This is not intended to limit the present invention. That is, as far as the position detection sensor 62 is arranged on the upstream side of the registration roller pair 27 in the paper conveying direction FD, any configuration can be adopted. However, if a loop (warp) is formed on the paper P when the position detection sensor 62 detects the position of the side edge of the paper P, the reading accuracy may decrease due to the change in the height (i.e. the position in the vertical direction) of the paper P. Hence, it is preferable that the position detection sensor 62 be arranged on a path that is not affected by the loop (over a section of the conveyance path, the section where the paper P is conveyed horizontally (i.e. along and on the conveyance path)).

Figure 22:
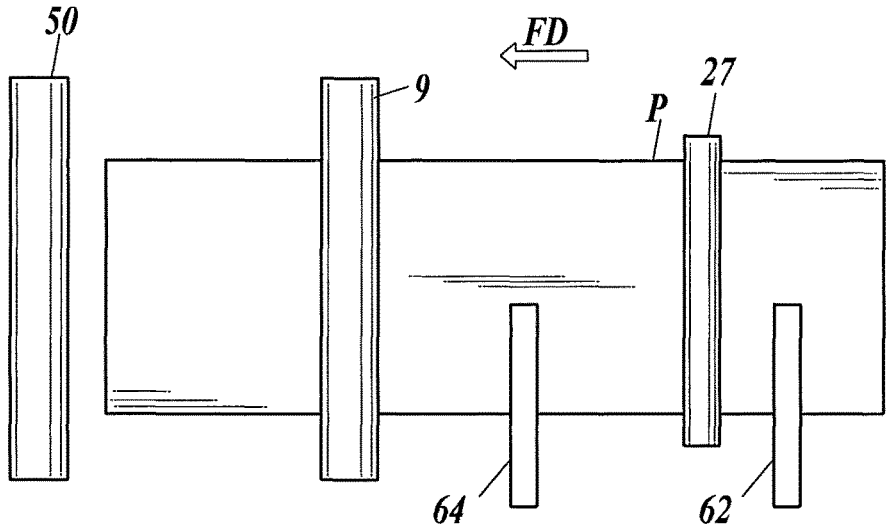
FIG. 22 shows an example of arrangement of the position detection sensors.

Further, in the fifth embodiment, the position detection sensor 62 is arranged on the upstream side of the registration roller pair 27 in the paper conveying direction FD only. This is not intended to limit the present invention. That is, as far as one position detection sensor 62 is provided on the upstream side of the registration roller pair 27 in the paper conveying direction FD, any configuration can be adopted. For example, as shown in FIG. 22, in addition to the position detection sensor 62, a position detection sensor 64 may be arranged between the registration roller pair 27 and the secondary transfer roller pair 9 as a second position detection sensor.

Thus, arranging the position detection sensor 64 between the registration roller pair 27 and the secondary transfer roller pair 9 makes it possible to detect variation in the paper conveyance caused by the registration roller pair 27. Further, arranging the position detection sensor 64 as close to the secondary transfer roller pair 9 as possible makes it possible to match the position of the paper P with the image forming position of the secondary transfer roller pair 9 accurately.

In the case where two position detection sensors, namely, 62 and 64, are used for the sway control of the registration roller pair 27 as described above, the sway of the registration roller pair 27 may be determined on the basis of each detection result or the detection results by the position detection sensors 62, 64 together. The sway is performed by the sway amount, the sway direction and the sway speed.

For example, in the case where the sway is determined on the basis of each detection result, it is possible to first sway the registration roller pair 27 on the basis of the detection result by the position detection sensor 62, and thereafter sway the registration roller pair 27 on the basis of the detection result by the position detection sensor 64.

Alternatively, in the case where the sway is determined on the basis of the detection results by the two positional detection sensors together, it is possible to calculate the slope (curve in the sub-scanning direction) of the paper P, and sway the registration roller pair 27 on the basis of the calculated slope of the paper P. The slope of the paper P can be calculated by dividing the "difference between X1 and X2 in the paper width direction" by the "conveyance distance between X1 and X2", wherein X1 and X2 represent detected coordinates of the position of the side edge of the paper P at two points in the paper conveying direction FD. Thus, calculating the slope of the paper P on the basis of the detection results by the two position detection sensors can reduce the number of times that the position of the side edge of the paper P is detected, and accordingly can increase a processing speed.

Figure 23:
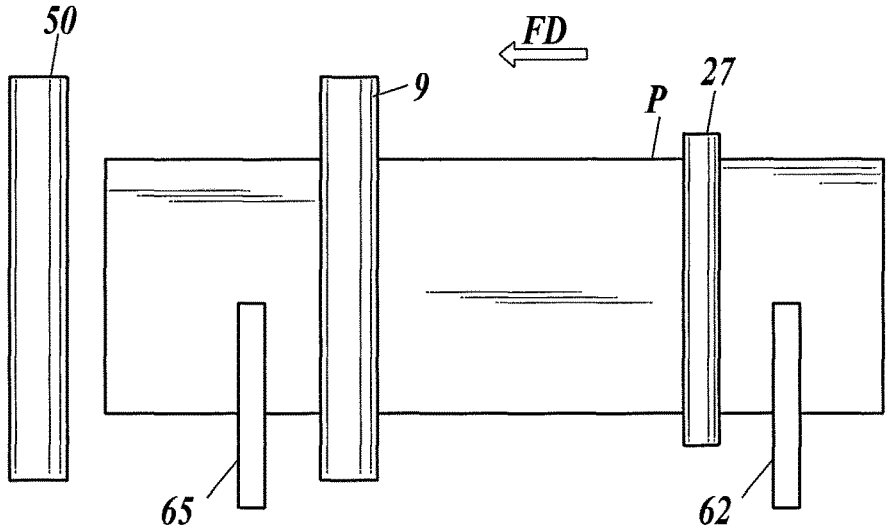
FIG. 23 shows an example of arrangement of the position detection sensors.

As another example, as shown in FIG. 23, in addition to the position detection sensor 62, a position detection sensor 65 may be arranged between the secondary transfer roller pair 9 and the fixing device 50 as a second position detection sensor.

Thus, arranging the position detection sensor 65 between the secondary transfer roller pair 9 and the fixing device 50 makes it possible to detect variation in the paper conveyance caused by the secondary transfer roller pair 9. Further, arranging the position detection sensor 65 on the downstream side of the secondary transfer roller pair 9 makes it possible to read the formed image, and accordingly match the position of the paper P with the image forming position of the secondary transfer roller pair 9 for sure.

Figure 24:
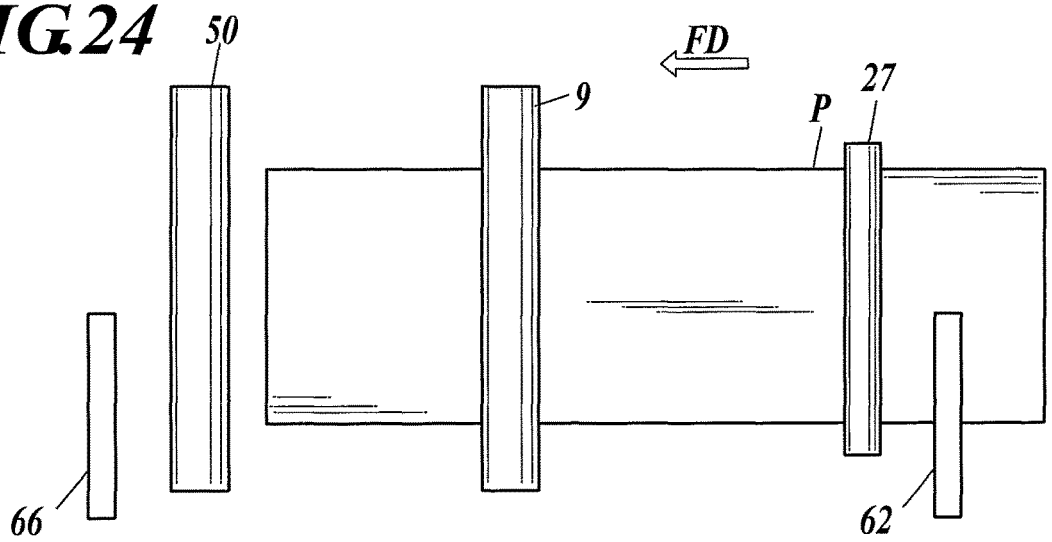
FIG. 24 shows an example of arrangement of the position detection sensors.

As another example, as shown in FIG. 24, in addition to the position detection sensor 62, a position detection sensor 66 may be provided on the downstream side of the fixing device 50 in the paper conveying direction FD (to be specific, between the fixing device 50 and a conveying roller pair next to the fixing device 50 on the downstream side of the fixing device 50 in the paper conveying direction FD) as a second position detection sensor.

Thus, arranging the position detection sensor 66 on the downstream side of the fixing device 50 in the paper conveying direction FD makes it possible to detect variation in the paper conveyance caused by the fixing device 50. Further, arranging the position detection sensor 66 on the downstream side of the fixing device 50 makes it possible to detect paper curving (i.e. the sub-scanning curving) caused by the fixing device 50 which has high conveyance pressure (i.e. conveyance power or nip power) in particular, and accordingly to match the position of the paper P with the image fruiting position of the secondary transfer roller pair 9 more surely.

In the example shown in FIG. 24, the position detection sensor 66 is arranged between the fixing device 50 and the conveying roller pair next to the fixing device 50 on the downstream side of the fixing device 50 in the paper conveying direction FD. This is not intended to limit the present invention. That is, as far as the position detection sensor 66 is arranged on the downstream side of the fixing device 50 in the paper conveying direction FD, any configuration can be adopted. For example, the position detection sensor 66 may be arranged near the paper receiving tray 29.

Further, as far as one position detection sensor 62 is provided on the upstream side of the registration roller pair 27 in the paper conveying direction FD, two or more position detection sensors may be additionally provided. For example, in addition to the position detection sensor 62, the position detection sensor 64 (shown in FIG. 22), the position detection sensor 65 (shown in FIG. 23) and the position detection sensor 66 (shown in FIG. 24) may be provided in any combination.

Further, although, in the fifth embodiment, the registration roller pair 27 is swayed on the basis of the detection result by the position detection sensor 62 and the predetermined sway control information, the sway control information may be corrected on the basis of the detection result by the position detection sensor 62 detected after the registration roller pair 27 sways. In this case, for example, on the basis of the detection result of a sheet of the paper P, the sway control information may be corrected for the next sheet. Alternatively, for example, on the basis of the detection result of the top side of a sheet of the paper P, the sway control information may be corrected for the bottom side of the sheet itself.

Further, in each of the first to fourth embodiments, in addition to the position detection sensor 62, two or more of the position detection sensor 64 shown in FIG. 16 or FIG. 19, the position detection sensor 65 shown in FIG. 17 or FIG. 20 and the position detection sensor 66 shown in FIG. 18 or FIG. 21 may be provided, and the controller 11 may determine the sway control information on the basis of the detection results by the plurality of the position detection sensors.

Further, in the above embodiments, the controller 11 may calculate the slope of the paper P on the basis of the detection result by the position detection sensor 62 and the detection result(s) by the position detection sensor(s) 64, 65 and/or 66, and determine the sway control information at each sway timing on the basis of the calculated slope.

Further, in the above embodiments, the image forming apparatus is a color image forming apparatus that primary-transfers images formed on photoconductive drums to an intermediate transfer belt/roller, and secondary-transfers the images from the intermediate transfer belt/roller to paper by a secondary transfer roller pair. The present invention is also applicable to a monochrome image forming apparatus that directly transfers images from a photoconductive drum to paper by a transfer roller pair.

Further, in the above embodiments, the registration roller pair 27 sways in the direction orthogonal to the paper conveying direction. The sway direction does not need to be the direction orthogonal to the paper conveying direction as far as it is a direction that can change the direction to send/convey the paper P.

Further, in the above embodiments, the registration roller pair 27 is the sway roller pair. This is not intended to limit the present invention. For example, the sway roller pair may be provided separately from the registration roller pair 27.

Further, in the above embodiment, the image forming apparatus is an electrophotographic image forming apparatus. This is not intended to limit the present invention. For example, the present invention is also applicable to an inkjet image forming apparatus that discharges ink from nozzles to a recording medium in such a way as to put the ink thereon in a desired pattern, thereby recording an image(s) on the recording medium (e.g. an inkjet recording apparatus that discharges ink which is cured by predetermined energy rays, and cures the ink discharged onto a recording medium by irradiating the ink with the predetermined energy rays, thereby fixing the ink to the recording medium).

Further, in the above, as a computer readable medium for the programs of the present invention, a nonvolatile memory, a hard disk or the like is used. This is not intended to limit the present invention. The computer readable medium may be a portable recording/storage medium, such as a CD-ROM. Further, as a medium to provide data of the programs of the invention, a carrier wave can be used.

In addition to the above, the specific configurations/components and the specific operations of the image forming apparatus can also be appropriately modified without departing from the scope of the present invention.

Although several embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Applications No. 2017-118216, No. 2017-125735 and No. 2017-130395 filed on Jun. 16, 2017, Jun. 28, 2017 and Jul. 3, 2017, respectively, is incorporated herein by reference in its entirety.

What is claimed is:

1. An image forming apparatus comprising:

a transfer unit that transfers an image onto paper;

a fixing unit that fixes, to the paper, the image transferred onto the paper by the transfer unit;

a sway roller pair constituted of a pair of rollers that conveys the paper to the transfer unit, the paper being conveyed to the sway roller pair;

a first detector that is provided on a downstream side of the transfer unit but on an upstream side of the fixing unit and detects a position of a side edge of the paper;

a second detector that is provided on the downstream side of the fixing unit and detects the position of the side edge of the paper;

a hardware processor that performs sway control of the sway roller pair based on a detection result of the detection by the first detector and the second detector; and a fan positioned to face the first detector, wherein a paper conveyance path is provided between the fan and the first detector, and paper is conveyed along the conveyance path by the fan.

2. The image forming apparatus according to claim 1, wherein the hardware processor determines sway control information on the sway roller pair based on the detection result by the first detector, and performs the sway control of the sway roller pair based on the determined sway control information.

3. The image forming apparatus according to claim 2, wherein the first detector is provided over, of a paper conveyance path, a side where the toner image is transferred onto the paper, and detects the position of the side edge of the paper and a position of the image on the paper, and the hardware processor determines the sway control information based on the position of the side edge of the paper and the position of the image on the paper detected by the first detector.

4. The image forming apparatus according to claim 2, wherein the hardware processor determines the sway control information for a paper conveyance condition.

5. The image forming apparatus according to claim 2, wherein the hardware processor determines, for each of multiple timings at which the sway roller pair is swayed, the sway control information based on the detection result by the first detector.

6. The image forming apparatus according to claim 1, further comprising a third detector that is provided on the upstream side of the sway roller pair and detects the position of the side edge of the paper, wherein the hardware processor performs the sway control of the sway roller pair further based on a detection result of the detection by the third detector.

7. The image forming apparatus according to claim 1, further comprising a fourth detector that is provided on the downstream side of the sway roller pair but on the upstream side of the transfer unit and detects the position of the side edge of the paper, wherein the hardware processor performs the sway control of the sway roller pair further based on a detection result of the detection by the fourth detector.

8. The image forming apparatus according to claim 1, wherein the sway roller pair sways in a direction orthogonal to a conveying direction of the paper.

9. An image forming apparatus comprising:

a transfer unit that transfers an image onto paper;

a fixing unit that fixes, to the paper, the image transferred onto the paper by the transfer unit;

a sway roller pair constituted of a pair of rollers that conveys the paper to the transfer unit, the paper being conveyed to the sway roller pair;

a detector that is provided on a downstream side of the fixing unit and detects a position of a side edge of the paper;

a hardware processor that performs sway control of the sway roller pair based on a detection result of the detection by the detector; and a fan positioned to face the first detector, wherein a paper conveyance path is provided between the fan and the first detector, and paper is conveyed along the conveyance path by the fan.

10. The image forming apparatus according to claim 9, wherein the hardware processor determines sway control information on the sway roller pair based on the detection result by the first detector, and performs the sway control of the sway roller pair based on the determined sway control information.

11. The image forming apparatus according to claim 10, wherein the detector is provided over, of a paper conveyance path, a side where the toner image is transferred onto the paper, and detects the position of the side edge of the paper and a position of the image on the paper, and the hardware processor determines the sway control information based on the position of the side edge of the paper and the position of the image on the paper detected by the detector.

12. The image forming apparatus according to claim 10, wherein the hardware processor determines the sway control information for a paper conveyance condition.

13. The image forming apparatus according to claim 10, wherein the hardware processor determines, for each of multiple timings at which the sway roller pair is swayed, the sway control information based on the detection result by the detector.

14. An image forming apparatus comprising:

a transfer unit that transfers an image onto paper being conveyed to an image transfer position where the transfer unit transfers the image onto the paper;

a sway roller pair constituted of a pair of rollers that conveys the paper to the transfer unit, the paper being conveyed to the sway roller pair;

at least one detector that is provided on an upstream side of the sway roller pair in a conveying direction of the paper and detects a position of a side edge of the paper, the at least one detector including a first detector provided on a downstream side of a fixing unit in the conveying direction, the fixing unit fixing, to the paper, the image transferred onto the paper by the transfer unit;

a hardware processor that makes the sway roller pair sway based on a detection result of the detection by the at least one detector and predetermined sway control information; and a fan positioned to face the first detector, wherein a paper conveyance path is provided between the fan and the first detector, and paper is conveyed along the conveyance path by the fan.

15. The image forming apparatus according to claim 14, further comprising a second detector is further provided between the sway roller pair and the transfer unit.

16. The image forming apparatus according to claim 14, further comprising a third detector is further provided between the transfer unit and the fixing unit that fixes, to the paper, the image transferred onto the paper by the transfer unit.

17. The image forming apparatus according to claim 14, wherein the sway control information is determined for a paper conveyance condition.

18. The image forming apparatus according to claim 17, further comprising a storage that stores a table where the sway control information for the paper conveyance condition is stored.

* * * * *